US006328619B1

(12) United States Patent
Shimizu et al.

(10) Patent No.: US 6,328,619 B1
(45) Date of Patent: Dec. 11, 2001

(54) EQUIPMENT AND METHOD FOR PRODUCING SPARK PLUG

(75) Inventors: Kenji Shimizu, Nagoya; Yutaka Tanaka, Kasugai, both of (JP)

(73) Assignee: NGK Spark Plug Co., Ltd., Nagoya (JP)

( * ) Notice: Subject to any disclaimer, the term of this patent is extended or adjusted under 35 U.S.C. 154(b) by 0 days.

(21) Appl. No.: 09/260,085

(22) Filed: Mar. 2, 1999

(30) Foreign Application Priority Data

Mar. 3, 1998 (JP) ..... 10-069583

(51) Int. Cl.[7] ..... H01T 21/02
(52) U.S. Cl. ..... 445/7
(58) Field of Search ..... 313/136, 141; 445/7

(56) References Cited

U.S. PATENT DOCUMENTS 4,414,483 * 11/1983 Nishio et al. ..... 445/7
4,482,475 11/1984 Sakai et al. ..... 252/506

FOREIGN PATENT DOCUMENTS 0 484 168 A2 10/1991 (EP) .
0 484 168 A3 10/1991 (EP) .

* cited by examiner

*Primary Examiner*—Ashok Patel
*Assistant Examiner*—Todd Reed Hopper
(74) *Attorney, Agent, or Firm*—Morgan, Lewis & Bockius LLP

(57) ABSTRACT

A spark plug assembly is produced in the following manner. Namely, an insulator having an axial through-hole with a metallic terminal fixed at an end thereof and a center electrode fixed at the other end and with packing layers of bulk powders of a conductive glass seal layer, a resistor and the like being formed in the through-hole between the metallic terminal and the center electrode. Subsequently, the spark plug assembly is heated so that the temperature of the side closer to the center electrode is higher than that of the side closer to the metallic terminal along the longitudinal axis of the insulator. Then, the packing layers of the bulk powders within the through-hole are pressed between the center electrode and the metallic terminal by applying pressure to the heated spark plug assembly so that the metallic terminal comes closer to the center electrode along the axis of the through-hole with the position of the center electrode being fixed relative to the through-hole.

13 Claims, 19 Drawing Sheets

PLUG ASSEMBLIES PRODUCING STEP

SETTING PLUG ASSEMBLIES TO SETTER

TO HEATING STEP

FIG. 18A
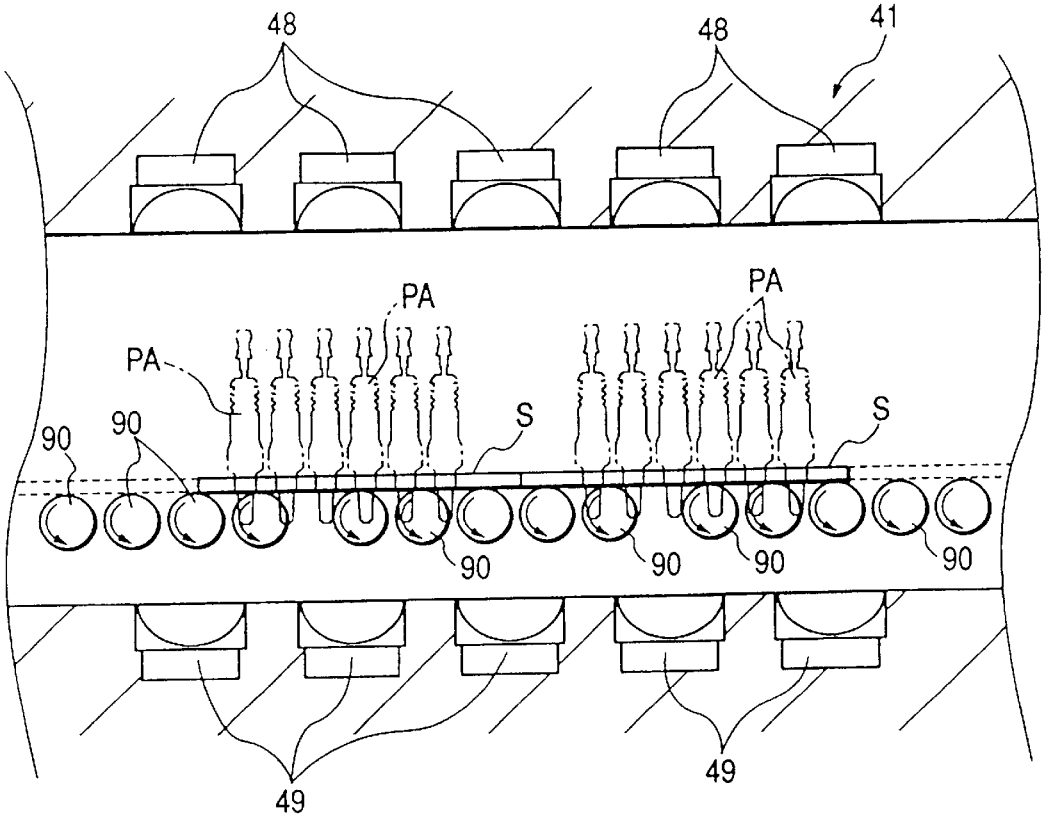
FIG. 18B
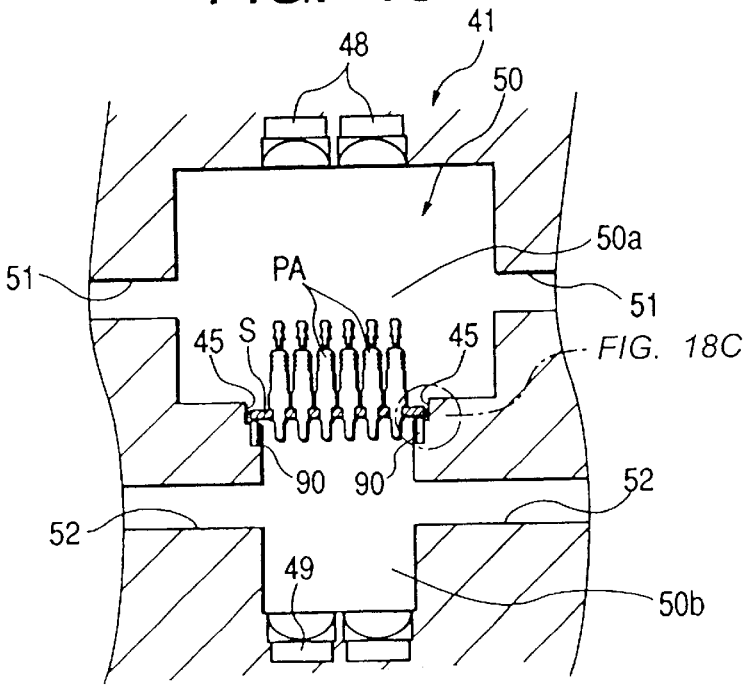
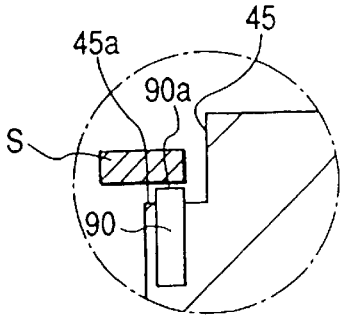
FIG. 18C

EQUIPMENT AND METHOD FOR PRODUCING SPARK PLUG

BACKGROUND OF THE INVENTION

1. Field of the Invention

The present invention relates to equipment and a method for producing spark plugs. More particularly, the present invention relates to an equipment and a method for producing a spark plug including an insulator having an axial through-hole in which a metallic terminal fixed at an end portion thereof and a center electrode fixed at the other end thereof and a sintered conductive material member such as a conductive glass seal layer or a resistor being formed within the through-hole between the metallic terminal, and the center electrode to establish their electrical connection.

2. Field of the Invention

Conventional spark plugs for use in internal combustion engines have built-in resistors with a view to suppressing the generation of noise from electrical waves. Such spark plugs with a built-in resistor includes an insulator having an axial through-hole with a metallic terminal fixed at an end thereof and a center electrode fixed at the other end thereof and the resistor provided in the through-hole between the metallic terminal and the center electrode. A conductive glass seal layer is usually provided between the resistor and the metallic terminal or between the resistor and the center electrode to connect them electrically.

A typical method for producing the spark plug with a built-in resistor is shown in FIGS. 23A and 23B. In short, a center electrode 3 is inserted into a through-hole 6 in an insulator 2 and, thereafter, a conductive glass powder, a bulk powder of resistor composition and another mass of conductive glass powder are packed in that order. Finally, a metallic terminal 13 is pressed into the through-hole 6 from the side opposite to the center electrode 3, thereby making a spark plug assembly. Thus, the through-hole 6 in the insulator 2 contains a conductive glass powder layer 26 therein, a resistor composition powder layer 25 and another conductive glass powder layer 27 that are superposed one on another in that order from the center electrode 3. The spark plug assembly having this layer arrangement is brought into a heating furnace where it is heated to a temperature higher than the glass softening point. Thereafter, the metallic terminal 13 is uniaxially pushed in from the side opposite to the center electrode 3, whereby the respective layers 25 to 27 are compressed to form glass seal layers 16 and 17 and a resistor 15 as shown in FIG. 23B.

In the above-described method for the production of spark plugs with a built-in resistor, the individual layers are compressed by a so-called "one-side press" method. Namely, the metallic terminal 13 is pushed in toward the center electrode 3 with the position of the latter fixed. In this case, the conductive glass powder layer 26 located in the lowest position in FIG. 23A does not receive a sufficient pressing force due to the friction between the overlaying packings and the inner surface of the through-hole 6. Accordingly, the compression or flow of the powder is inhibited, sometimes causing poor sintering of the glass seal layer 16 on account of its low density. If this situation occurs, the carbon in the glass seal layer 16 is burnt away or the metallic component is oxidized. As a result, the electrical continuity between the resistor 15 and the center electrode 3 via the glass seal layer 16 becomes imperfect and as the use of the spark plug is prolonged. It may be that the conduction resistance increases to potentially cause occasional misfiring.

SUMMARY OF THE INVENTION

It is an object of the present invention to provide an equipment for producing a spark plug by the "one-side press" method with the metallic terminal pushed toward the center electrode but with a smaller possibility for the occurrence of poor electrical connection between the metallic terminal and the center electrode via the conductive glass seal layer(s), the resistor and any other intervening elements.

It is another object of the present invention to provide a method for producing spark plugs using the equipment. According to the present invention, the equipment and the method for producing a spark plug which comprises an insulator, a metallic terminal, a center electrode and a conductive material. In the insulator, a through-hole is formed in an axial direction of the insulator. The metallic terminal is fixed at one end of the through-hole. The center electrode fixed at the other end of the through-hole. A sintered conductive material member comprising a mixture of glass and a conductive material being formed within the through-hole between the metallic terminal and the center electrode for connecting the metallic terminal and the center electrode electrically.

The equipment has a heating device for heating a spark plug assembly comprising an insulator in which a through-hole is formed in an axial direction of the insulator, a metallic terminal fixed at one end of the through-hole, a center electrode fixed at the other end of the through-hole and a packing layer of a bulk powder of the sintered conductive material member being formed in the through-hole between the metallic terminal and the center electrode so that the packing layer of the bulk powder begins to soften from the center electrode side along the longitudinal axis of the insulator.

In the equipment, the spark plug assembly is heated by the heating device so that the temperature of the center electrode side is higher than that of the metallic terminal side along the axial direction of the insulator.

The method for producing a spark plug comprises: preparing a spark plug assembly having a metallic terminal fitted at an end of the through-hole in the insulator and a center electrode fitted at the other end thereof and a packing layer of a bulk powder of the sintered conductive material member being formed in the through-hole between the metallic terminal and the center electrode; heating the spark plug assembly so that the layer packed with the bulk powder begins to soften from the center electrode side along the axis direction of the insulator; and pressing the packing layer of the bulk powder within the through-hole between the center electrode and the metallic terminal by applying pressure to the heated spark plug assembly so that the metallic terminal comes closer to the center electrode along the axis of the through-hole with the position of the center electrode being fixed relative to the through-hole.

If the spark plug assembly is heated such that the packing layer of the bulk powder begins to soften from the center electrode side along the longitudinal axis of the insulator, the softening of the glass in the packing layer will be subjected at a faster rate on the side closer to the center electrode along the axis of the packing layer than on the side closer to the metallic terminal. If the packing layer is pressed by the so-called "one-side press" method, with pressure applied from the metallic terminal side toward the center electrode side along the longitudinal axis, even the bulk powder on the center electrode side which is resistant to the propagation of applied pressure undergoes a smaller flow resistance due to the progress of glass softening and can be compressed as efficiently as the bulk powder on the metallic terminal side. As the result, the sintered conductive material member is efficiently compressed and sintered not only on the metallic terminal side but also on the center electrode side, thus ensuring satisfactory electrical connection to be established at all times between the sintered conductive material member and the center electrode.

One way to soften the packing layer of the bulk powder from the center electrode side along the axis of the insulator is by heating the spark plug assembly such that its center electrode side has a higher temperature than the metallic terminal side to ensure preferential softening or melting of the glass in that part of the packing layer of the bulk powder which is located on the center electrode side. Another way is by using a glass of the lower softening point in that part of the packing layer of the bulk powder which is on the center electrode side while using a glass of the higher softening point on the metallic terminal side. With this composition, the packing layer of the bulk powder can be softened starting from the center electrode side under such heating conditions that the temperature of the metallic terminal side is substantially the same as or slightly higher than that of the center electrode side.

The heater to be used in the production equipment of the invention may specifically take the form of a heating furnace having a heating chamber formed in the interior for accommodating spark plug assemblies. The heating chamber can be adapted to be such that spark plug assemblies are placed in the interior with each insulator erecting in the axial direction. In this case, the heating furnace can be furnished with heating sources on a side that is either above or below the spark plug assemblies arranged in the heating chamber and which faces the center electrode. This design provides ease in establishing the conditions for heating the spark plug assemblies in the furnace according to the invention such that their center electrode side has a higher temperature than the metallic terminal side.

The heater may be adapted as one including gas burners. Described below are the action and advantages of this modification.

An electric furnace using resistive heating elements is conventionally employed as a furnace for heating the spark plug assemblies. FIG. 22 shows such electric furnace which is indicated by 200. As shown, a plurality of spark plug assemblies PA are transported in a row through the furnace housing 201 of a tunnel type with each insulator erecting in the axial direction while. At the same time, the radiant heat from resistive heating elements 202 placed on both sides of the passage line is applied to the side of each spark plug assembly PA. A problem with this approach of lateral heating by radiation is that it has such a low efficiency that much time is required to heat all spark plug assemblies uniformly, thus lowering the production efficiency.

Unlike electric heaters and other devices that solely depend on the transfer of radiant heat, gas burners used as heating sources, achieve heating by the flame they produce. Hence, the transfer of radiant heat is combined with heat transfer by convection due to the fluid motion of the flame. As the result, the efficiency of the heat transfer to the spark plug assemblies is markedly improved and the desired temperature can be reached within such a short period that the heating time is sufficiently shortened to improve the production rate remarkably and realize great saving of energy. In addition, expensive electrical energy need not be used but the combustion energy of inexpensive gases is used to cut the energy cost. As a further advantage, convection allows hot gas streams to flow along the surfaces of the spark plug assemblies (or insulators), thus realizing more uniform heating of the spark plug assemblies than the electric heater. Even if a plurality of spark plug assemblies are arranged in close proximity to one another within the furnace, hot gas streams can be distributed evenly among all gaps to ensure that a number of spark plug assemblies are heated uniformly at a time, thus contributing to a higher production efficiency.

The gas burners may be cup burners each consisting of a cup-shaped heat radiator that is oriented in such a way that the opening from which heat radiates faces toward a spark plug assembly and a burner body that has a flame ejecting port open to the bottom of the cup-shaped heat radiator. With such cup burners, the heat radiator is heated with the flame from the burner body and convected heat transfer due to the flame is combined with the transfer or radiant heat from the heat radiator to achieve more uniform heating of the spark plug assemblies.

In this case, the heating furnace may be adapted to have both an entrance through which the spark plug assembles to be heated are introduced into the heating chamber and an exit through which the heated spark plug assemblies emerge from the heating chamber, with a passage line for the spark plug assemblies being formed along the path leading from the entrance to the exit via the heating chamber and with a plurality of heating sources being spaced along the passage line on whichever its top or bottom side that faces the center electrode of each spark plug assembly. With this arrangement, the spark plug assemblies are heated by a plurality of heating sources as they are transported continuously or intermittently along the passage line through the heating chamber. As the result, the spark plug assemblies being sequentially supplied by the transport action can be heated in succession, realizing further improvement in the efficiency of the heating method. It should be noted here that if the heating sources include gas burners, a plurality of gas burners can be spaced along the passage line on whichever its top or bottom side that faces the center electrode of each spark plug assembly.

In this case, spark plug assembly holders may be provided, which detachably hold spark plug assemblies so that the insulator of each spark plug assembly is erected in the axial direction. With them being held in such holders, the spark plug assemblies can be transported along the passage line through the heating chamber. Each spark plug assembly holder may be adapted to hold a plurality of spark plug assemblies at least across the width of the passage line so that the spark plug assemblies in such holders are heated with gas burners as they are transported through the heating chamber.

For example, referring to the conventional electric furnace 200 in FIG. 22, if the number of spark plug assemblies PA that are arranged across the width of the passage line for transport is increased in order to improve the efficiency of treatment, the line of inwardly positioned spark plug assembles will not be able to receive an adequate amount of radiant heat from the resistive heating elements 201 due to blocking by the outwardly positioned spark plug assemblies and this increases the chance of the making of defective products due to insufficient or nonuniform heating. To deal with this problem, the maximum number of spark plug assemblies that can be arranged across the width of the passage line has not been greater than two and it has been impossible to expect a dramatic improvement in the efficiency of spark plug manufacture. In contrast, the above-described production equipment of the present invention enables heat to be distributed evenly among the small gaps between spark plug assemblies PA by virtue of convected heat transfer. As the result, a large number of spark plug assemblies PA can be heated simultaneously and uniformly, thus achieving a marked improvement in both the efficiency and yield of spark plug manufacture.

It should be mentioned that the press can be provided adjacent to the exit of the heating furnace, together with a transport mechanism by which an individual spark plug assembly emerging from the heating furnace is brought to a specified pressing position as it is contained in the associated holder. With this design, the spark plug assemblies can be subjected to the pressing step immediately after the heating step and this contributes to a further improvement in the efficiency of treatments. In addition, the spark plug assemblies emerging from the heating furnace will be cooled only insufficiently to make defective products.

It should also be mentioned that the heating furnace may be provided with auxiliary heating sources that are located on the side opposite to the aforementioned heating sources in the axial direction of the insulator and which generate less heat than the latter. This design enables the spark plug assemblies to be heated to the desired temperature within an even period of time. Again, the auxiliary heating sources may be composed of gas burners.

BRIEF DESCRIPTION OF THE DRAWINGS

In the accompanying drawings:

FIG. 18A is a front view, partially in section, of a modification of the transport means in the heating furnace;

FIG. 18B is a side sectional view of the modification;

FIG. 18C is a partial enlarged sectional view of FIG. 18B;

PREFERRED EMBODIMENTS OF THE INVENTION

Preferred embodiments of the present invention will now be described with reference to the examples shown in the accompanying drawings.

Figure 1:
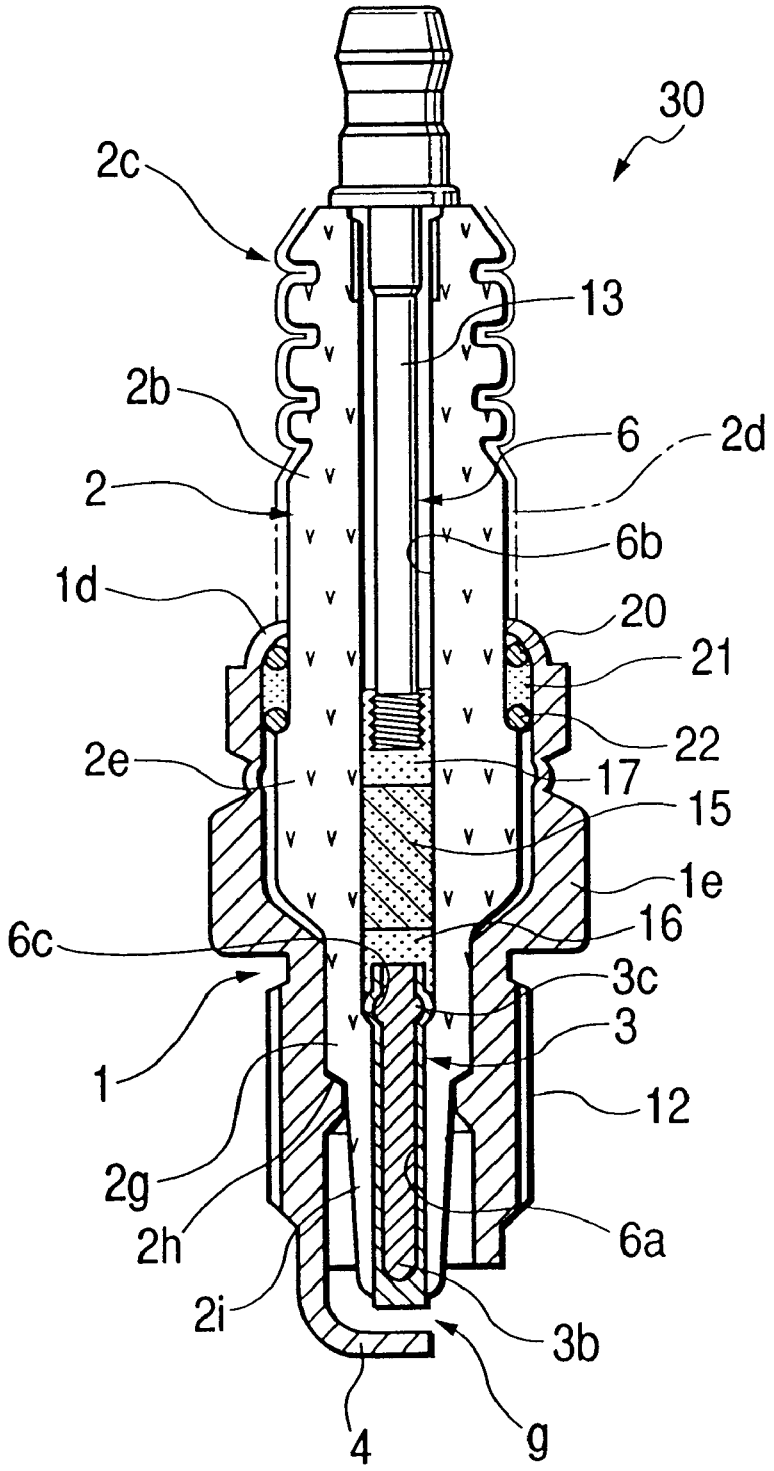
FIG. 1 is a front sectional view showing an example of a spark plug manufactured by the spark plug production equipment of the present invention.

FIG. 1 shows an example of the spark plug that are manufactured by the production equipment of the invention. Being designed as a spark plug with a built-in resistor, the spark plug 30 in FIG. 1 is essentially composed of a metallic shell 1, an insulator 2 fitted into the metallic shell 1 with upper half exposed, a center electrode 3 provided in the interior of the insulator 2, and a ground electrode 4 that is welded or otherwise coupled at an end to the metallic shell 1, in which the other end of the ground electrode 4 is laterally being back so that its lateral side faces the tip of the center electrode 3. A spark gap g is formed between the ground electrode 4 and the center electrode 3. The metallic shell 1 is typically formed of a carbon steel and has a threaded portion 12 around the lower part of its circumference for assisting in the mounting of the spark plug on an engine (not shown). The center electrode 3 is typically formed of a Ni alloy. The insulator 2 is made of a sinter of a ceramic such as alumina.

A through-hole 6 is formed along the axis of the insulator 2. A metallic terminal 13 is inserted into and fixed at an end of the through-hole 6 and the center electrode 3 is inserted into and fixed at the other end. A resistor 15 is provided in the through-hole 6 between the metallic terminal 13 and the center electrode 3. An end of the resistor 15 is electrically connected to the center electrode 3 via a conductive glass seal layer 16 and the other end is connected to the metallic terminal 13 via a conductive glass seal layer 17. In the case shown in FIG. 1, the resistor 15 and the conductive glass seal layers 16 and 17 form sintered conductive material members.

The resistor 15 is made of a resistor composition that is a sinter of a mixture of a glass powder and a conductive material powder (and optionally a non-glass ceramic powder). Using this resistor composition, the resistor 15 is produced and shaped by the method that is described below in detail. The conductive glass seal layers 16 and 17 are each made of a glass mixed with a powder of a metal such as Cu or Fe (or an alloy thereof).

As shown in FIG. 1, a radially outwardly projecting portion 2*e* is formed, typically as a flange, around the insulator 2 in the middle of its axis. The insulator 2 has a body portion 2*b* with a smaller diameter in an area rearward of the projecting portion 2*e*, the term "rearward" meaning an area remote from the area closer to the tip of the center electrode 3. A first shaft portion 2*g* of a smaller diameter and a second shaft portion 21 of an even smaller diameter are formed "forward" of the projecting portion 2*e* in that order.

Glaze 2*d* is applied to the circumference of the body portion 2*b* and a corrugation 2*c* is formed around the rear end portion. The circumference of the first shaft portion 2*g* generally assumes a cylindrical shape whereas the circumference of the second shaft portion 2*i* generally assumes a conical shape that tapers toward the tip.

A cross section of the center electrode 3 taken perpendicular to its axis is set to have a smaller diameter than a cross section of the resistor 15 taken perpendicular to its axis. The through-hole 6 in the insulator 2 has a first, generally cylindrical portion 6*a* through which the center electrode 3 is passed and a second, generally cylindrical portion 6*b* that is formed rearward of the first portion 6*a* (i.e., upward in FIG. 1) and which is formed in a larger diameter. The metallic terminal 13 and the resistor 15 are received in the second portion 6*b* and the center electrode 3 is passed through the first portion 6*a*. Formed at the rear end of the center electrode 3 is an electrode fixing ridge 3*c* that projects outwardly from the circumference of the center electrode 3. The first portion 6*a* of the through-hole 6 and its second portion 6*b* connect to each other within the first shaft portion 2*g* and a ridge receiving surface 6*c* for receiving the electrode fixing ridge 3*c* of the center electrode 3 is formed in the position where the two portions are connected, with its surface tapered or made round. A core member 3*b* typically made of Cu or an alloy thereof is buried in the interior of the center electrode 3 in order to promote heat dissipation.

The area 2*h* where the first shaft portion 2*g* connects to the second shaft portion 2*i* has a step formed around the circumference. Since a ridge (not shown) is formed as an engaging portion on the inner surface of the metallic shell 1, the insulator 2 can be prevented from slipping out of the metallic shell 1 by engaging the stepped surface with the ridge via an annular sheet of packing. An annular line of packing 22 that engages the periphery of the rear end of the flange-like projecting portion 2*e* is provided between the inner surface of the opening at the rear end of the metallic shell 1 and the outer surface of the insulator 2, and a ring of packing 20 is provided rearward of the packing 22 via a packing layer 21 of talc or the like. When the insulator 2 is pushed forward (toward the metallic terminal 1) and if the edge of the opening of the metallic shell 1 is clamped inward (toward the packing 20), a clamped portion 1*d* forms to have the metallic terminal 1 secured to the insulator 2.

Figure 2D:
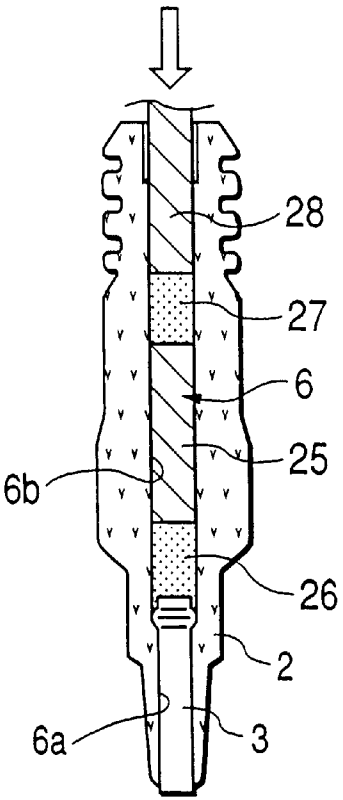
FIGS. 2A to 2D illustrate the sequence of steps of producing the spark of FIG. 1.
Figure 2C:
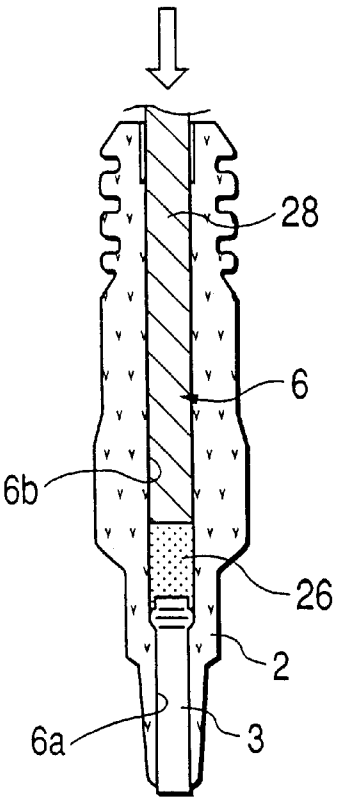
Figure 2B:
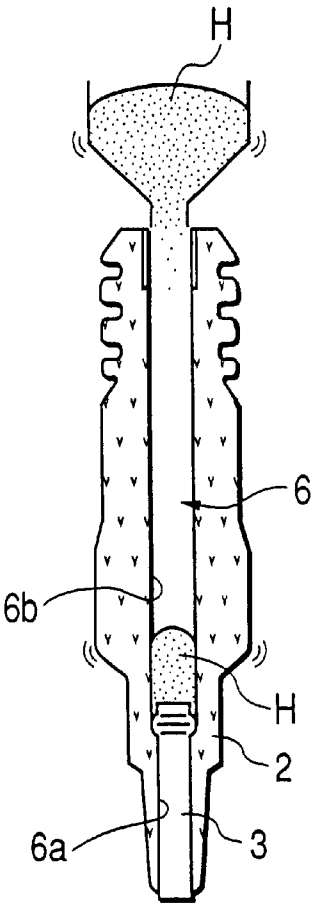
Figure 2A:
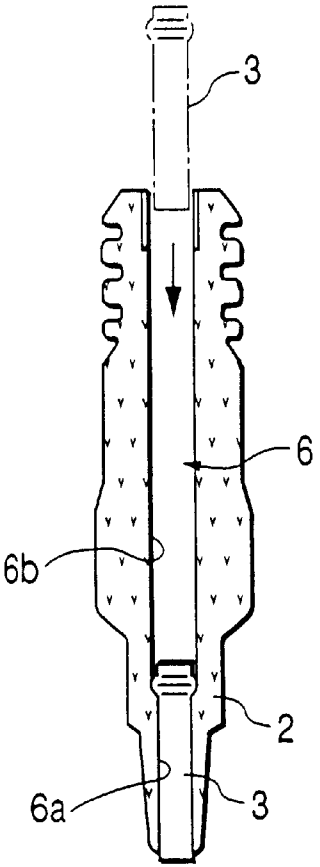

The procedure of mounting the center electrode 2 and the metallic terminal 13 into the insulator 2 of the above-described spark plug 30 with a built-in resistor and the procedure of forming the resistor 15 and the conductive glass seal layers 16 and 17 are outlined below. First, the center electrode 3 is inserted into the first portion 6*a* of the through-hole 6 in the insulator 2 (FIG. 2A) and, thereafter, a conductive glass powder H is packed in the lower part of the through-hole (FIG. 2B). Then, a pushing rod 28 is inserted into the through-hole 6 and the packed powder H is subjected to preliminary compression to form a first conductive glass powder layer 26 (FIG. 2C). Subsequently, a bulk powder of a resistor composition is packed and similarly subjected to preliminary compression. Another mass of a conductive glass powder is packed in the through-hole 6 and subjected to preliminary compression, whereupon the first conductive glass powder layer 26, a resistor composition powder layer 25 and a second conductive glass powder layer 27 are formed in superposition within the through-hole 6, with the layer 26 being positioned the lowest (in contact with the center electrode 3) (see FIG. 2D).

Figure 3A:
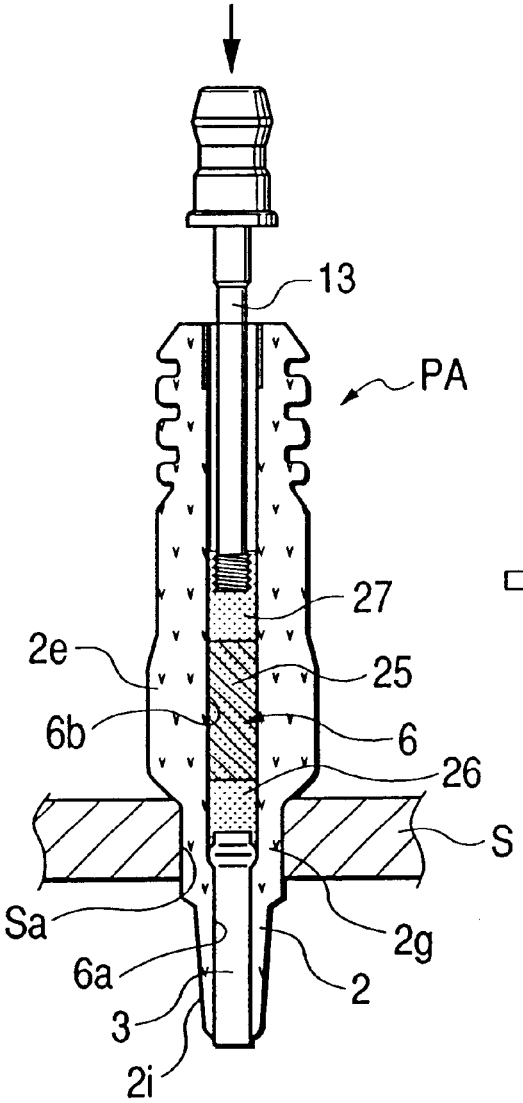
FIGS. 3A and 3B illustrate the step following FIGS. 2A to 2D.
Figure 3B:
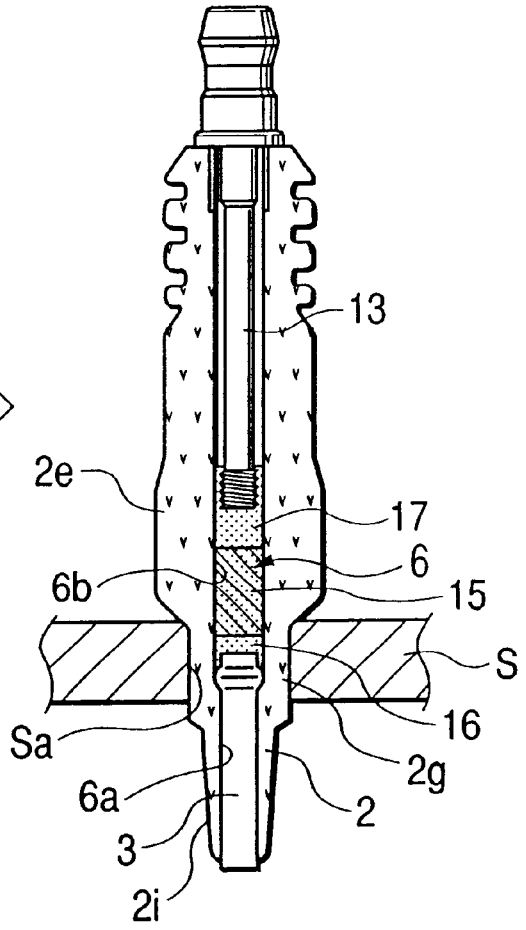

In the next place, the metallic terminal 13 is inserted into the through-hole 6 from above, thereby forming a spark plug assembly PA (FIG. 3A). The thus formed PA is charged into a furnace, where it is heated to a specified temperature of 900 to 1,000° C. which is higher than the glass softening point (provided that the temperature means the average for the whole lot of spark plug assemblies PA to be heated). Thereafter, the metallic terminal 13 is forced axially into the through-hole 6 from the side opposite to the center electrode 3 so that the superposed layers 25 to 27 are pressed in the axial direction. As the result, the respective layers are compressed and sintered to provide the conductive glass seal layer 16, resistor 15 and conductive glass seal layer 17 (FIG. 3B).

Figure 4A:
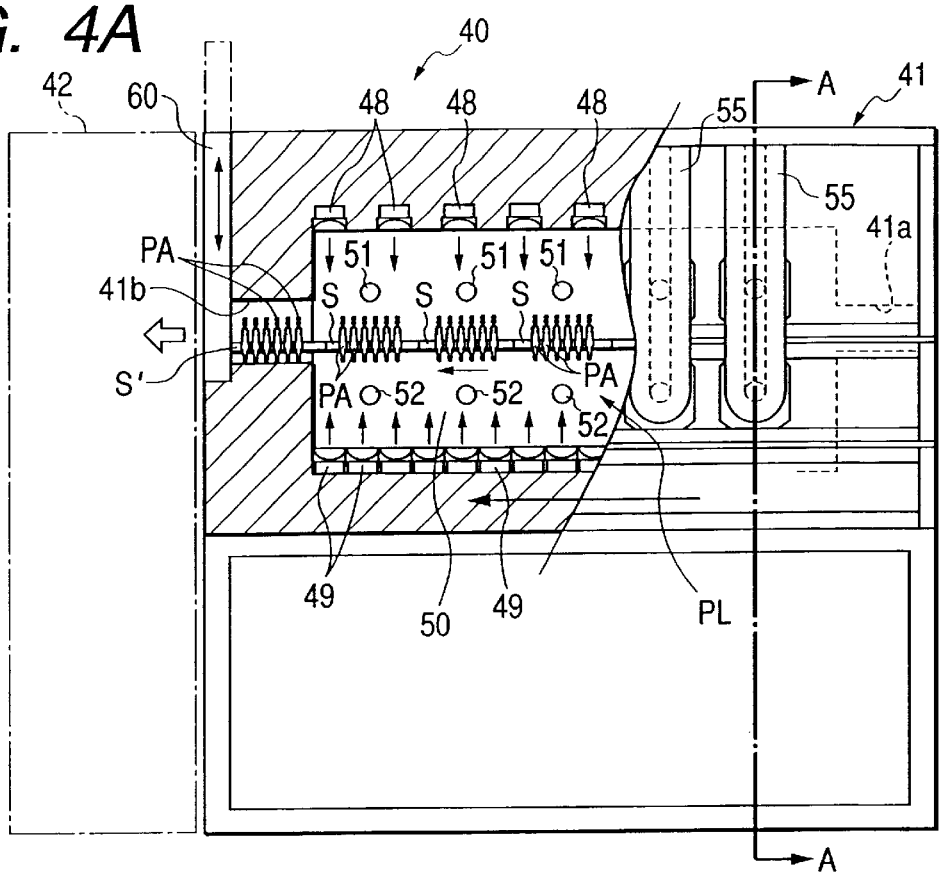
FIG. 4A is a general side view, partially in section, of an example of the spark plug production equipment of the invention.
Figure 4B:
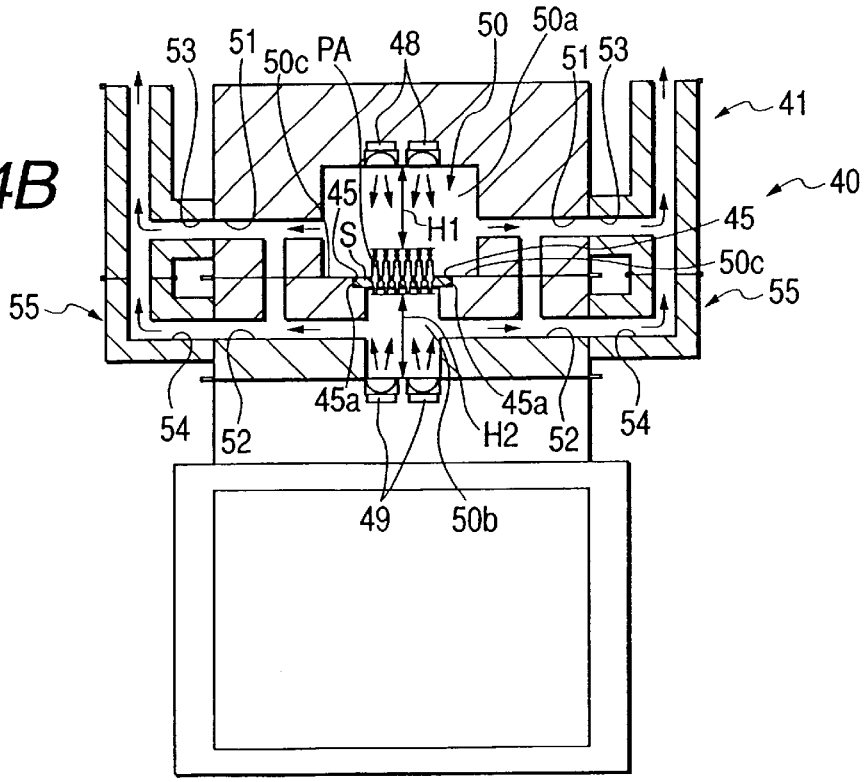
FIG. 4B is section A—A of FIG. 4A.

FIGS. 4A and 4B show an example of the spark plug production equipment 40 of the present invention which can form the above-described resistor 15 and conductive glass seal layers 16 and 17. As shown in FIGS. 4A and 4B, the production equipment 40 includes a heating furnace (heater) for heating spark plug assemblies to a temperature higher than the glass softening point and a press 42 provided adjacent to the exit of the heating furnace 41. The heating furnace 41 has a heating chamber 50 in the interior, with the passage line PL for spark plug assemblies PA being formed as a path extending generally horizontal through the heating chamber 50; an entrance 41*a* is formed on lateral sides of the forward end of PA transport and an exit 41*b* is formed on lateral sides of the rear end. After being formed in the spark plug assembly production line shown in FIGS. 2A to 2D and 3A, a plurality of spark plug assemblies PA (36 in the example under consideration) are set in setters S that are spark plug assembly holders, brought successively into the heating chamber 50 from the entrance 41*a*, transported along the passage line PL and thereafter emerge from the exit 41*b*.

Figure 5A:
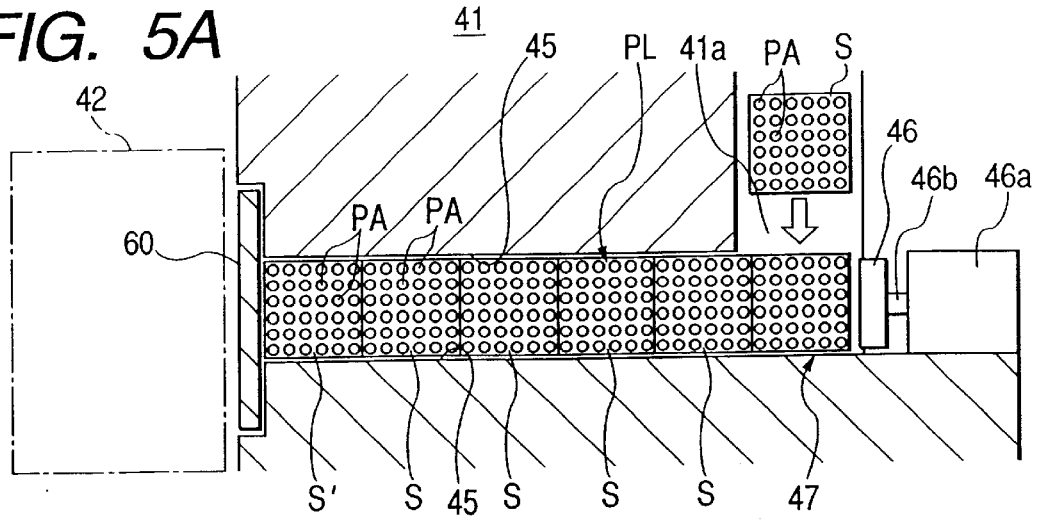
FIGS. 5A to 5C show plan views of the operational sequence of the equipment shown in FIGS. 4A and 4B.
Figure 5B:
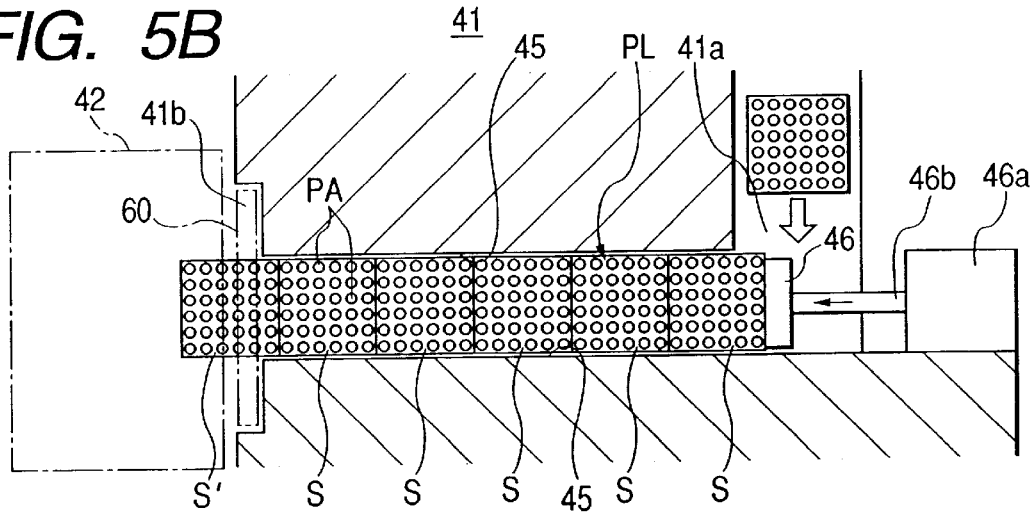
Figure 5C:
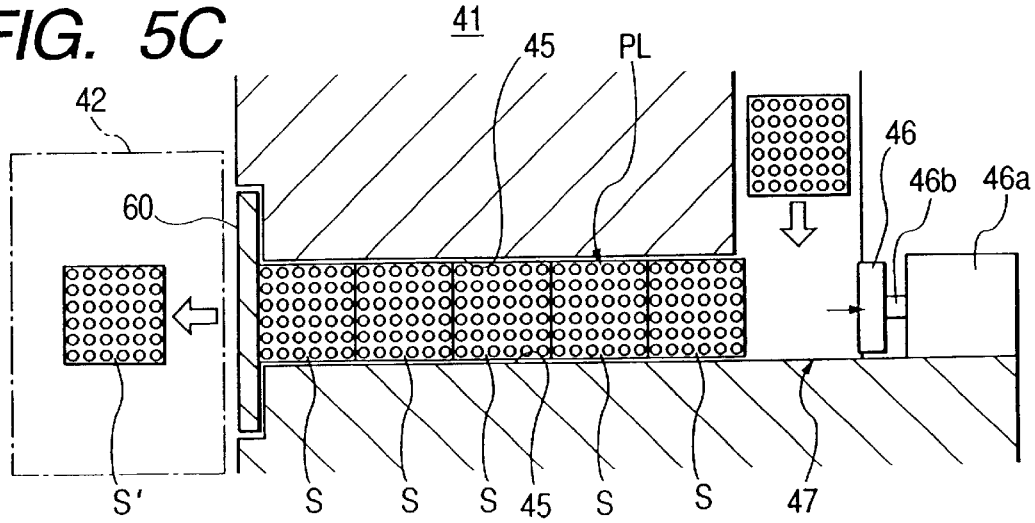

As shown in FIGS. 5A to 5C, the setter S is a rectangular ceramic or metallic plate which has a plurality of spark plug assembly holding through-holes Sa (which are hereinafter referred to simply as "holding through-holes" Sa; see FIG. 3A) formed in a matrix (6 holes in both a longitudinal and a transverse direction, totaling to 36 holes; in the example under discussion, an arrangement of holes in the direction of PA transport is called a row of longitudinal direction and an arrangement of holes in a direction perpendicular to PA transport is called a column of transverse direction). As shown in FIGS. 3A and 3B, each of the holding through-holes Sa is formed to be such that its inside diameter is a little larger than the outside diameter of the first shaft portion 2*g* of the insulator 2 but a little smaller than the outside diameter of the projecting portion 2*e*. When the spark plug assemblies PA are inserted, from above, into the holding through-holes Sa having these dimensional features, the setter S can hold the spark plug assemblies PA with the center electrode 3 facing down.

In the example under discussion, a column of six spark plug assemblies PA (see FIG. 13A) are formed as a group in the spark plug assembly production line shown in FIGS. 2A to 2D and 3A. Then, the column of six spark plug assemblies is set in the setter S and this setting step is repeated as many times as the number of columns (six times in the example under consideration) until spark plug assemblies PA are set in all of the holding through-holes Sa (see FIG. 13B).

As shown in FIGS. 4A and 4B, the heating chamber 50 of the heating furnace 41 has a plurality of gas burners (auxiliary heating sources) 48 provided on the top at specified spacings along the passage line PL; it also has a plurality of gas burners (main heating sources) 49 on the bottom at specified spacings along the passage line PL. Gas burners 48 are arranged in a plurality of rows (two rows in the example under consideration) in a direction transverse to the transport of the setter S and so are gas burners 49, except that they are grater in number than the gas burners 48 provided on the top of the heating chamber 50.

Figure 21:
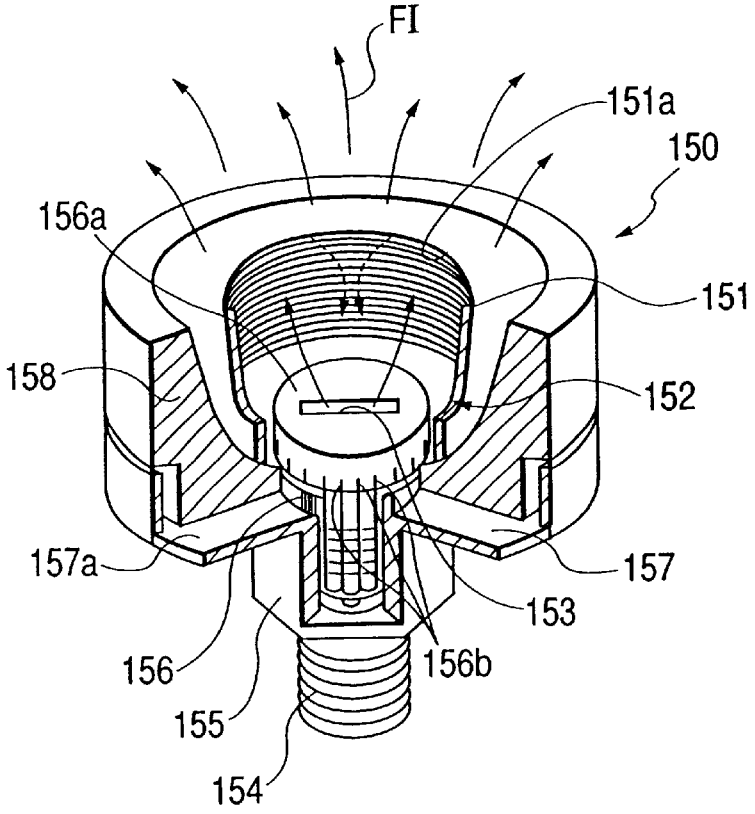
FIG. 21 is a perspective view, partially in section, of an exemplary cup burner.
Figure 22:
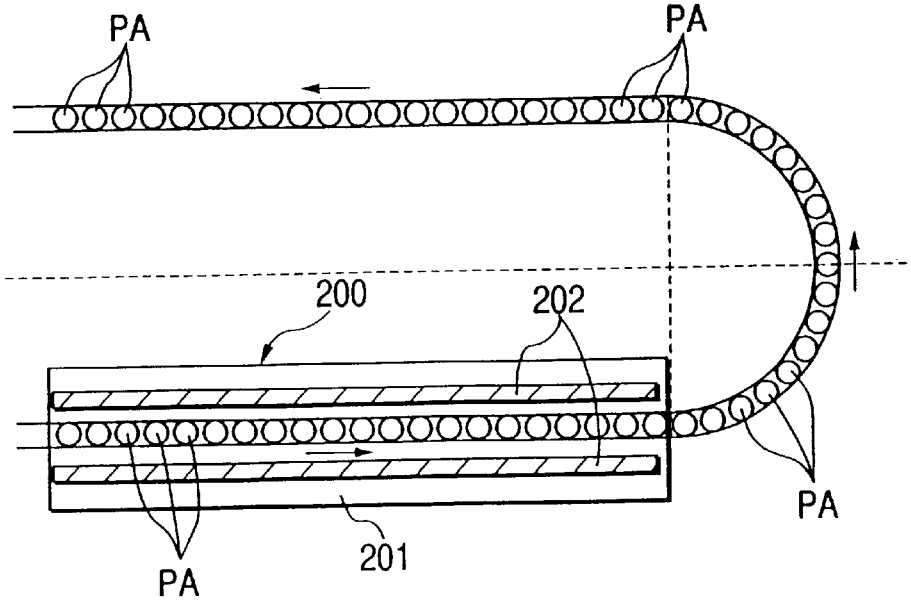
FIG. 22 illustrates a conventional spark plug production equipment.
Figure 23A:
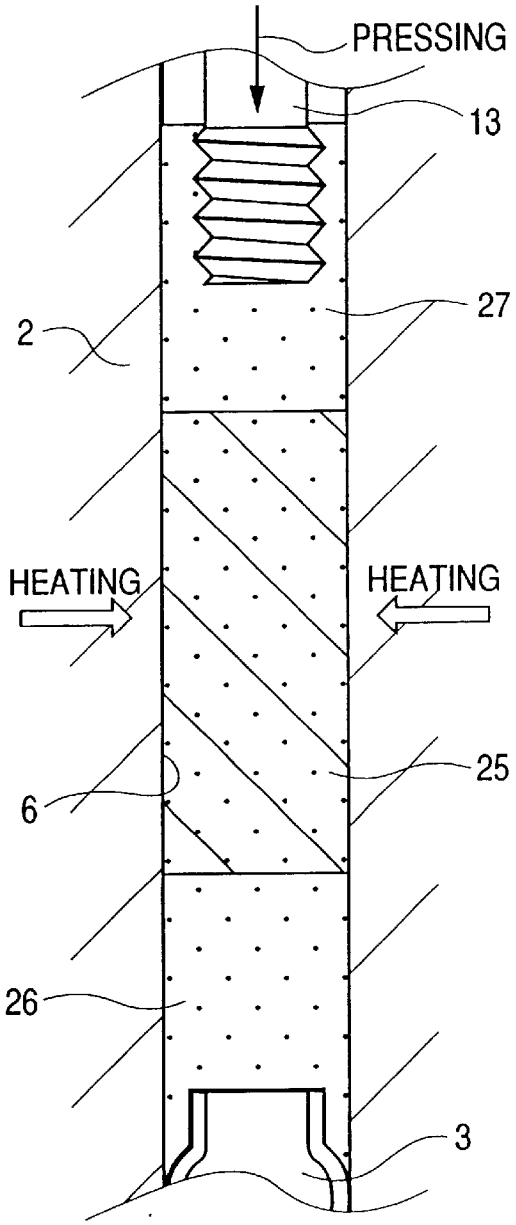
FIGS. 23A and 23B illustrate a problem involved in the conventional spark plug production equipment.
Figure 23B:
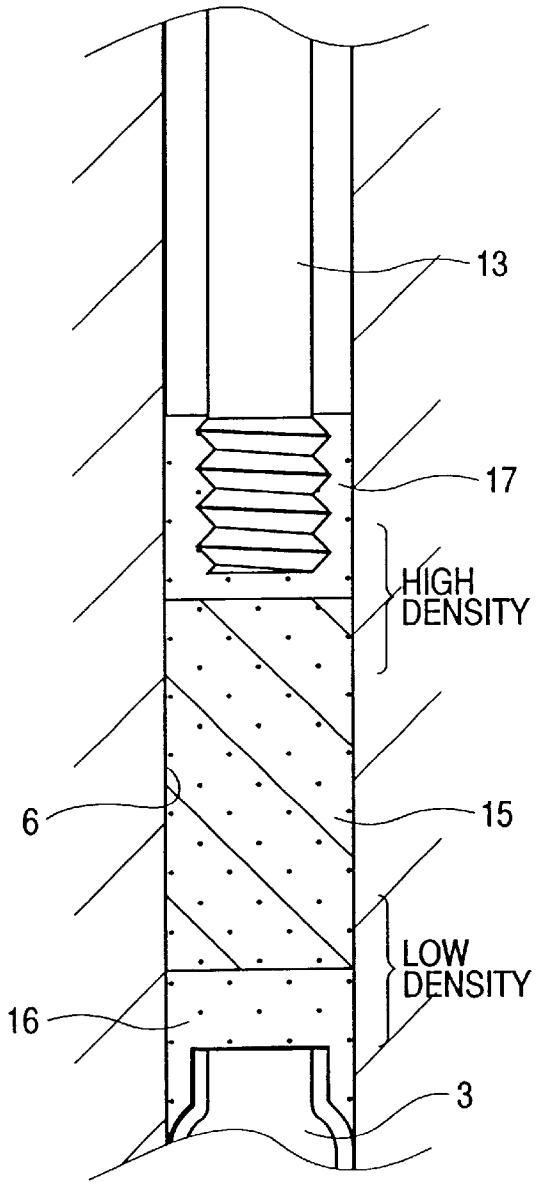

In the example under consideration, the gas burners 48 and 49 are in the form of cup burners. An exemplary cup burner is indicated by 150 in FIG. 21 and is constituted by a heat radiator 151 that is formed of a far infrared transmitting ceramic in a cup shape having an opening 151*a* and a burner body 152 having a flame ejecting port 153 that is open to the bottom of the cup-shaped heat radiator 151. The burner body 152 is constituted by a gas tube 155 having a mounting thread formed on the circumference of the gas receiving side 154 and a burner tip 156 which is fitted into the gas tube 155. The gas tube 155 has a radially extending outer tube receptacle 157 as an integral part of the top end of its circumference; the support surface 157*a* of the receptacle 157 has an outer tube 158 formed in such a way as to surround the heat radiator 151. The burner tip 156 extends through the bottoms of the heat radiator 151 and the outer tube 158 to be inserted axially into the gas tube 155; as shown, the head 156*a* of the burner tip 156 has a plurality of air introducing grooves 156*b* formed radially on the circumference.

Further referring to the cup burner 150, the gas tube 155 is supplied with a fuel gas such as natural gas or liquefied petroleum gas (LPG), which are mixed with the air fed through the air introducing grooves 156*b* formed on the circumference of the head of the burner tip 156, whereupon the mixture, flowing out of the flame ejecting port 153, burns to generate a flame. The flame heats the heat radiator 151 until it becomes red hot to radiate a far infrared (FI) radiation.

The gas burners 48 and 49 each being composed of the cup burner just described above are oriented in such a way that the opening 151*a* of the heat radiator 151 from which heat is to be radiated faces the spark plug assemblies PA. With this arrangement, the convected heat transfer from the flame is combined with the transfer of the radiant heat of the far infrared radiation from the heat radiator 151 to achieve uniform heating of the spark plug assemblies PA.

As shown in FIG. 4B, the inner surfaces of both walls of the heating chamber 50 have a ledge 50*c* that extends inwardly along the width of the passage line PL form the middle of the height of the heating chamber 50, with a guide groove 45 being formed along the inner edge of each ledge 50*c* (i.e., parallel to the passage line PL). As shown in FIG. 5A, a plurality of setters S line up, adjacent to one another, to bridge the guide grooves 45. As shown in FIG. 4B, each of the setters S is transported along the passage line PL as both edges of its underside are supported by the bottom surfaces 45*a* of guide grooves 45 while at the same time both lateral sides of its width are guided by the lateral sides of guide grooves 45.

The spark plug assemblies PA thus set on setters S in the heating chamber 50 have their upper portion heated with gas burners 48 and their lower portion heated with gas burners 49. The heating chamber 50 is divided into two parts by the setters S supported on guide grooves 45, one part above the passage line PL to form an upper heating chamber 50*a* and the other part below it to form a lower heating chamber 50*b*. A plurality of exhaust holes 51 are spaced on both lateral sides of the upper heating chamber 50*a* in the direction of PA transport, and a plurality of exhaust holes 52 are spaced on both lateral sides of the lower heating chamber 50*b* in the direction of PA transport. Mounted on the outer lateral sides of the heating furnace 41 are exhaust pipes 55 that have exhaust channels 53 and 54 communicating with the exhaust holes 51 and 52, respectively.

As shown in FIG. 5A, a pusher 46 as a setter transport means is provided in the passage line PL at the entrance of the heating furnace 41. The pusher 46 consists of a cylinder 46*a* and a piston rod 46*b* that is extended or contracted by the cylinder 46*a* so that the pusher 46 advances in the direction of transport of the setters or retracts in opposite direction. The setter S brought to a receiving position 47 formed at the entrance 41*a* of the passage line PL is pushed toward the exit (see FIG. 5B), whereupon the setter S is transferred into the heating furnace 41. As the result, the setters S arranged in close proximity in the direction of PA transport within the heating furnace 41 are pushed to move, whereupon the setter S' positioned the closest to the exit 41*b* is pushed out of the heating furnace 41.

Thus, the setters S which have been successively brought to the receiving position 47 are pushed into the heating furnace 41 by means of the pusher 46, whereupon the setters S are transported through the heating furnace 41 along the passage line PL intermittently at regular one-step intervals that are determined in correspondence with the length of each setter S.

In the embodiment under consideration, the temperature in the heating chamber 50 of the heating furnace 41 is adjusted to be such that the average ultimate temperature level for all spark plug assemblies lies within the range of 900 to 1,000° C. In addition, the transport speed of the setters S and, hence, the spark plug assemblies is adjusted to be such that they are heated at the indicated temperature for a period of 8 to 20 min. It should be remembered that the number of gas burners 48 located below the passage line PL through the heating chamber 50 is greater than that of gas burners 48 located above PL (see FIG. 4A) and, hence, a spark plug assembly PA set on the setter S as shown in FIG. 3A will be heated to have a higher temperature on the side closer to the center electrode 3 than on the opposite side (closer to the metallic terminal 13). The difference between the temperatures of the center electrode 3 and the metallic terminal 13 is preferably adjusted within the range of 0 to 100° C.

As is clear from FIG. 4B, in the example under consideration, the setting of the distance H1 from the line of upper gas burners 48 to the top of each spark plug assembly PA set on the setter S is substantially equal to the setting of the distance H2 from the line of lower gas burners 49 to the bottom of each spark plug assembly PA and, in addition, both the upper and lower gas burners are arranged in the same number of rows (two in the example under consideration). In the embodiment under consideration, the lower gas burners 49 are spaced apart in the passage line PL by a smaller distance than the upper gas burners 48 so that each spark plug assembly PA is heated to have a higher temperature on the side closer to the center electrode 3 than on the opposite side (closer to the metallic terminal 13). Alternative designs to attain the same result are the following; the upper gas burners 48 are arranged at substantially the same spacings as the lower gas burners 49 but in a smaller number of rows; the distance H1 is set to be greater than the distance H2; and the upper gas burners 48 are omitted.

Figure 6A:
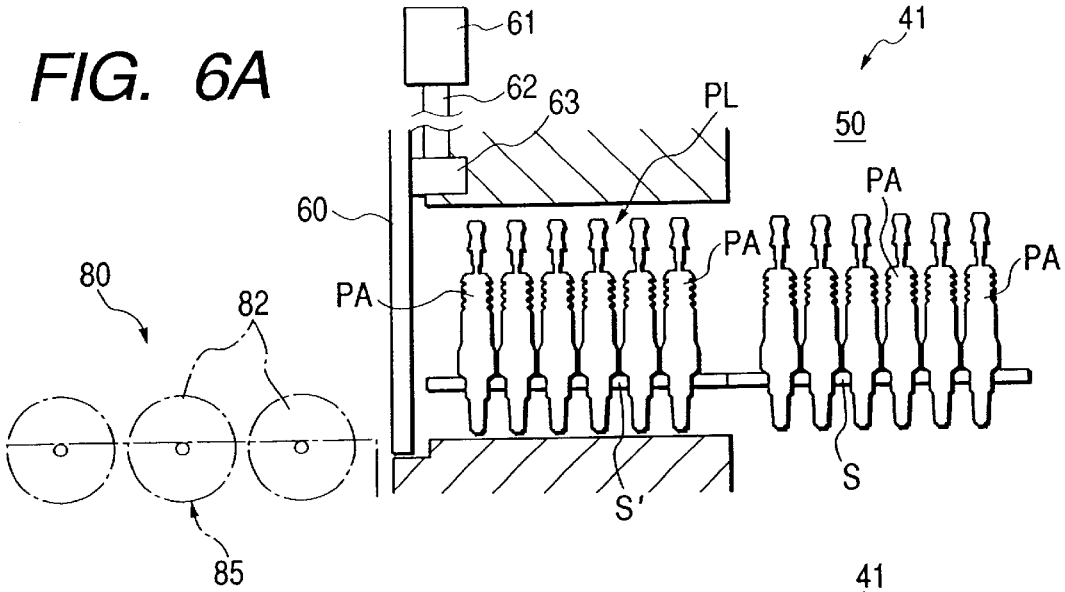
FIGS. 6A to 6C show enlarged side views of the operation of the transport mechanism in the production equipment.

As shown in FIGS. 4A and 5A to 5C, a shutter 60 is provided at the exit 41*b* of the heating furnace 41. As shown specifically in FIG. 6A, the shutter 60 is connected via a linking member 63 to a piston rod 62 which in turn is connected to a cylinder 61. As the piston 62 extends or contracts, the shutter 60 closes or opens the exit 41*b*. The shutter 60 provided at the exit 41*b* of the heating furnace 41 ensures that the press 42 and other mechanical parts located at the exit 41*b* will not be constantly exposed to high heat.

Figure 8A:
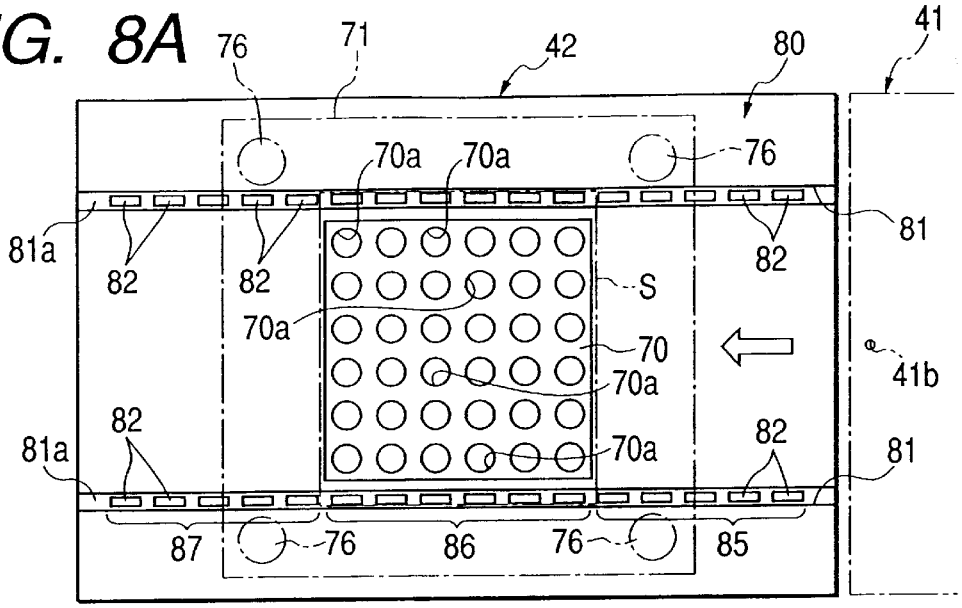
FIG. 8A is a plan view of a transporter conveyor.
Figure 12:
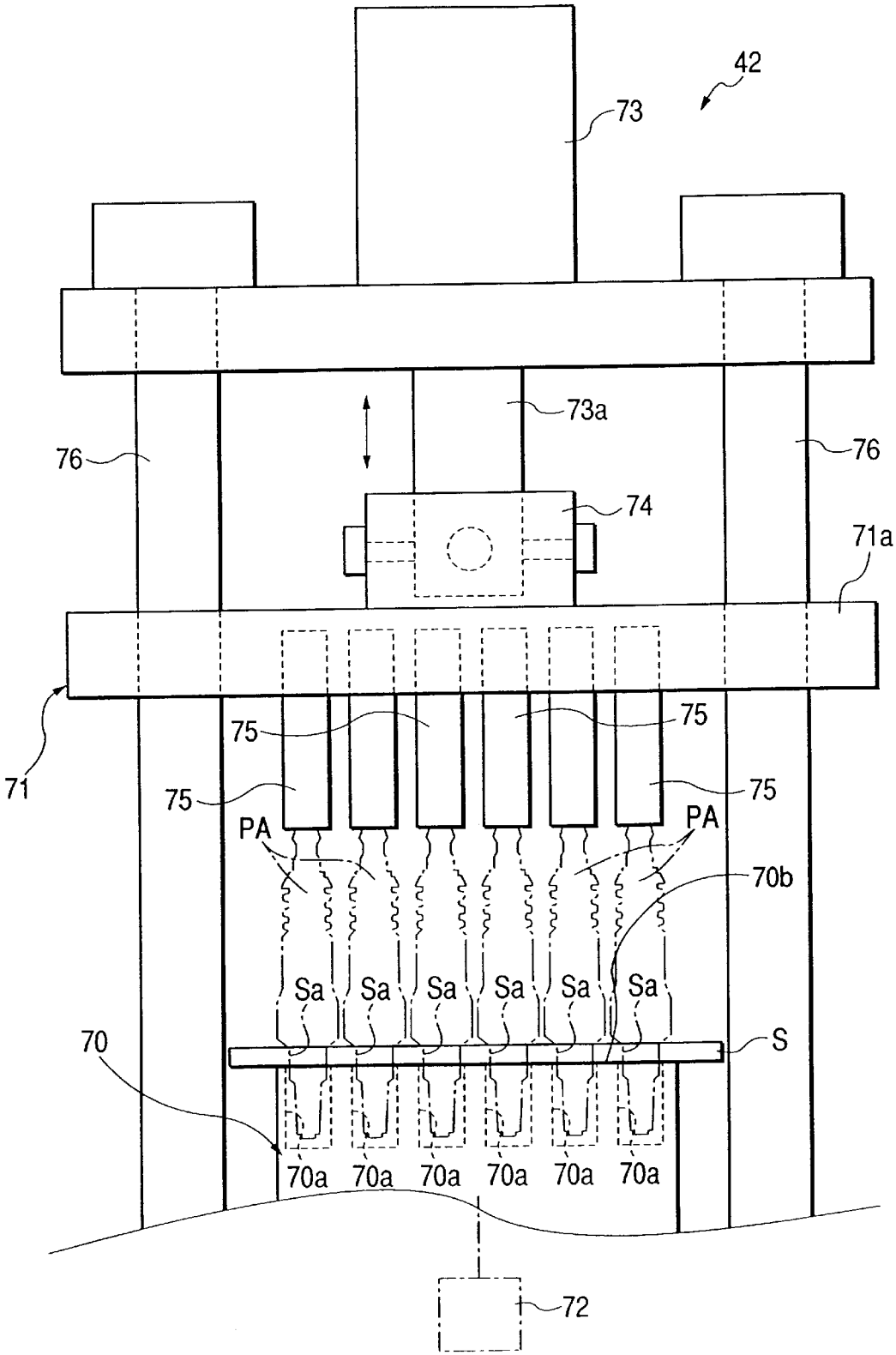
FIG. 12 is a front view of the press.

We now describe the press 42 with reference to FIG. 12. As shown, the press 42 is constituted by a lower die 70 that is adapted to approach the setter S from below or depart from it and which supports the setter S from the underside, an upper die 71 that is adapted to approach the setter S from above or depart from it and which applies axial pressure to the metallic terminals 13 of the spark plug assemblies PA set on the setter S, as well as cylinders 72 and 73 that drive the lower die 70 and the upper die 71, respectively. As shown in FIG. 8A, the lower die 70 assumes a generally square shape greater the outside dimension of the setter S. In addition, the lower die 70 has a plurality of recesses 70*a* that are open to the top in correspondence with the spark plug assembly holding through-holes Sa in the setter S. When the lower die 70 is raised by the cylinder 72, the recesses 70*a* will receive the second shaft portions 2*i* of the spark plug assemblies PA that project from the underside of the setter S (see FIG. 12). The lower die 70 supports the setter S by means of its top surface 70*b* which contacts the underside of the setter S.

The upper die 71 is constituted by a punch plate 71*a* and press pins 75 mounted on the underside of the punch plate 71*a*. The press pins 75 are provided in a one-to-one correspondence with the recesses 70*a* in the lower die 70, so in the example under consideration, 36 press pins 75 are provided. The punch plate 71*a* is coupled to the foremost end of a piston rod 73*a* on the cylinder 73 via a linking member 74 and as the piston rod 73*a* extends or contracts, the punch plate 71*a* will accordingly descend or ascend along guide members 76 that extend through its thickness. When the punch plate 71*a* descends with respect to the setter S supported on the lower die 70, the press pins 75 will come closer to the metallic terminals 13 of the spark plug assemblies PA, whereupon the respective layers 25 to 27 in the insulator 2 of each spark plug assembly PA (see FIG. 3A) will be pressed axially via the metallic terminal 13.

As shown in FIG. 8A, a transport conveyor (transport mechanism) 80 that is composed as a roller conveyor is provided in an area of the press 42 which is adjacent the exit of the heating furnace 41. After receiving the setter S pushed out of the exit 41*b* of the heating furnace 41, the transport conveyer 80 transports it to the pressing position in the press 42 and further transports it to a downstream position after pressing. In the transport conveyor 80, a guide groove 81 that is a little wider than the setter S is formed along the passage line PL through the heating furnace 41 (see FIGS. 8A, 8B and 9). A plurality of drive rollers 82 are provided on both sides of the guide groove 81 along its length, with the roll surface 82*a* being partly exposed from the bottom 81*a* of the guide groove 81.

Figure 8B:
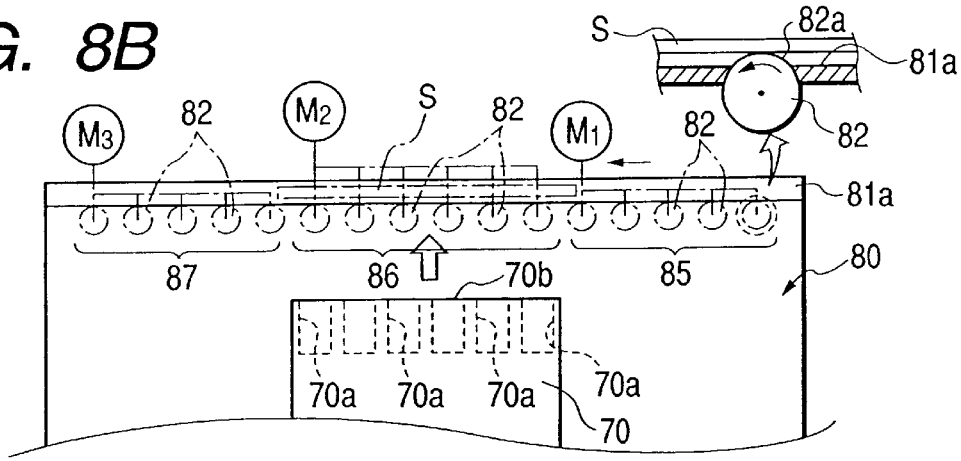
FIG. 8B is a side view of the transport conveyor.
Figure 9:
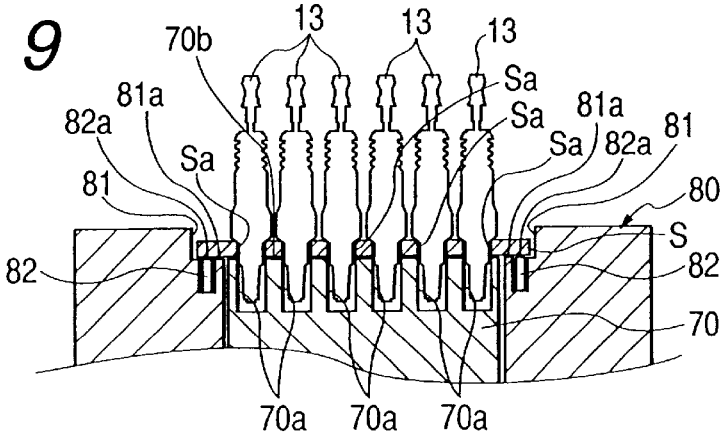
FIG. 9 is a sectional view showing a setter on the transport conveyor as it is supported by the lower die of a press.

As shown in FIG. 8B, the transport conveyor 80 includes an entry conveyor 85 consisting of a set of drive rollers 82 on the entrance side, an intermediate conveyor 86 consisting of a set of drive rollers 82 in the intermediate area and an exit conveyor 87 consisting of a set of drive rollers 82 on the exit side. These conveyors 85, 86 and 87 are driven by means of drive motors M1, M2 and M3 so that they are activated independently of one another. The lower die 70 and the upper die 71 of the press 41 are mounted in correspondence with the intermediate conveyor 86 in the direction of transport by the conveyor 80.

Figure 6B:
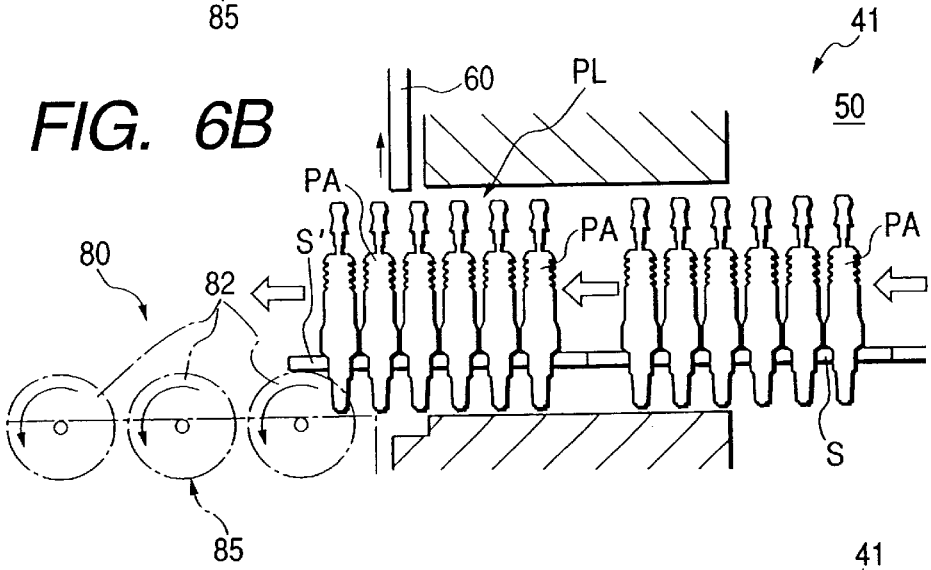
Figure 6C:
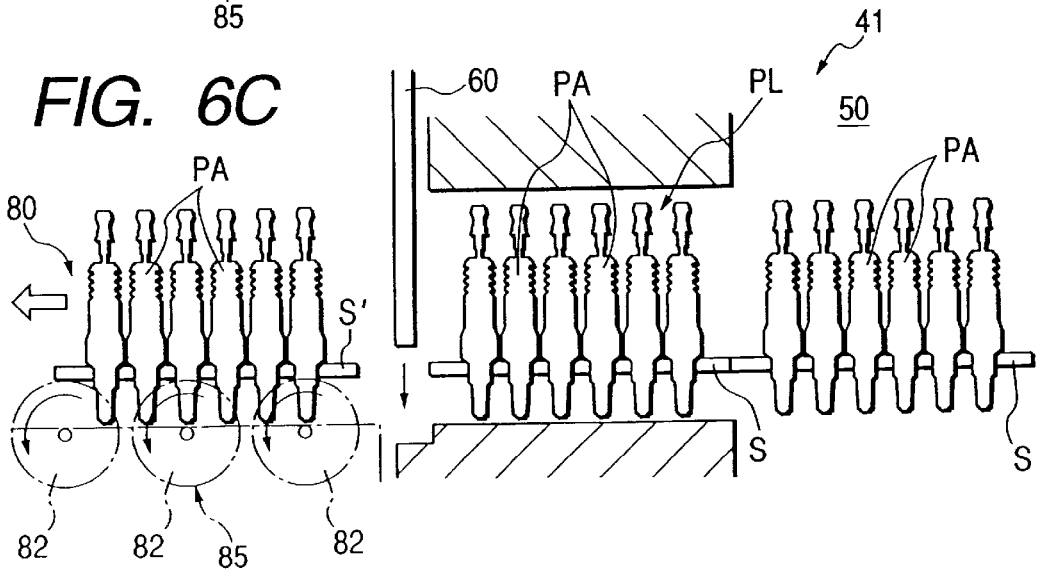
Figure 7:
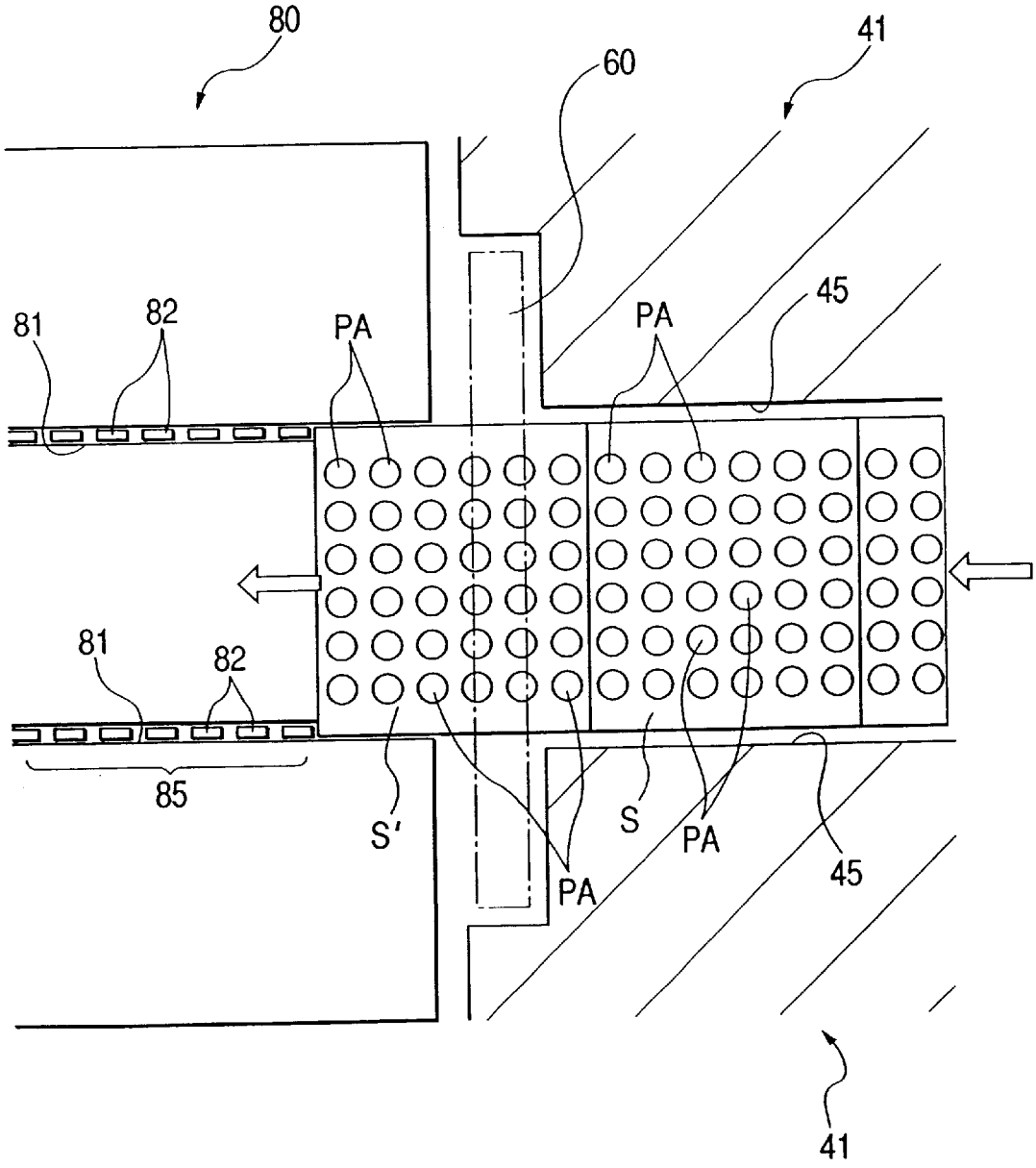
FIG. 7 is a partial enlarged plan view of FIG. 5B.
Figures 13A, 13B, 13C:
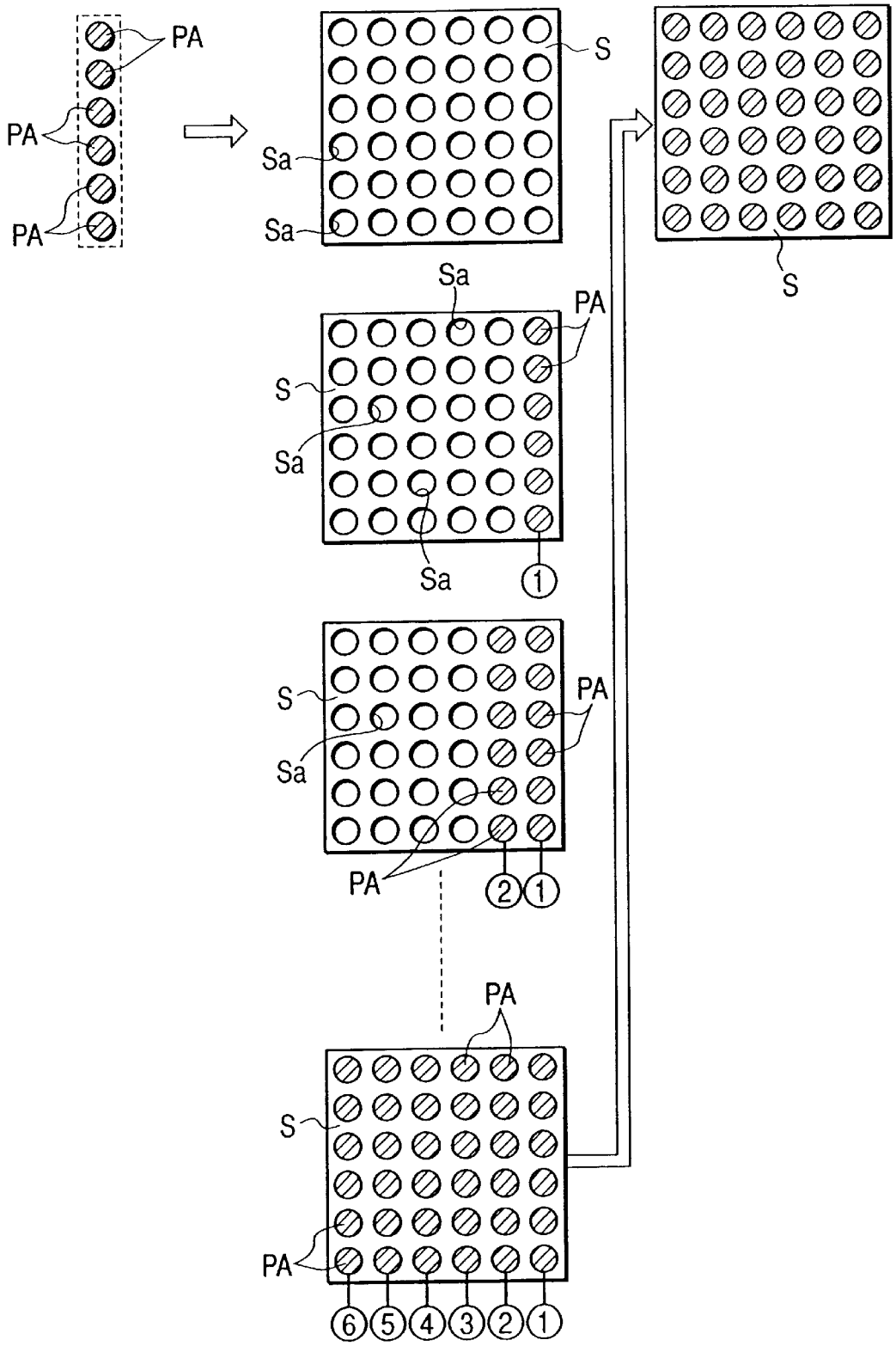
FIGS. 13A to 13C illustrate the step of setting spark plug assemblies on the setter.

We now describe the operation of the production equipment 40. As shown in FIGS. 13A to 13C, the setter S in which all (36) spark plug assemblies have been set in the holding through-holes Sa is transported toward the heating furnace 41. When the setter S has reached the setter receiving position 47 (see FIG. 5*a*), the shutter 60 opens and the pusher 46 is moved forward (FIG. 5B). As the result, the setter S is pushed toward the exit end of its transport and transferred into the heating furnace 41 while, at the same time, the setter S' at the exit end is pushed out of the heating furnace 41. When the setter S' is pushed out of the heating furnace 41 from the exit end, the drive rollers 82 in the entry conveyor 85 are driven to rotate by the motor M1 as shown in FIG. 6B and the setter S' is transferred onto the transport conveyor 80 (also see FIG. 7). When the setter S' is transferred onto the transport conveyor 80, the shutter 60 of the heating furnace 41 is closed.

Figure 10A:
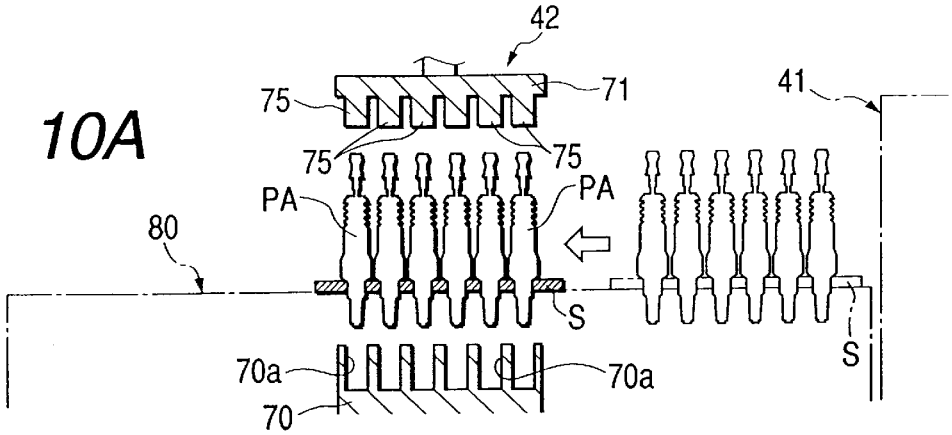
FIGS. 10A to 10D show schematically the operational sequence of the pressing step.
Figure 10B:
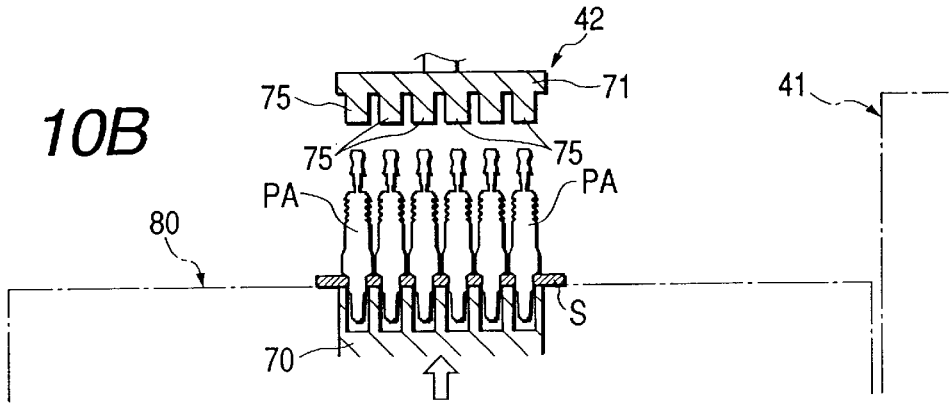
Figure 10C:
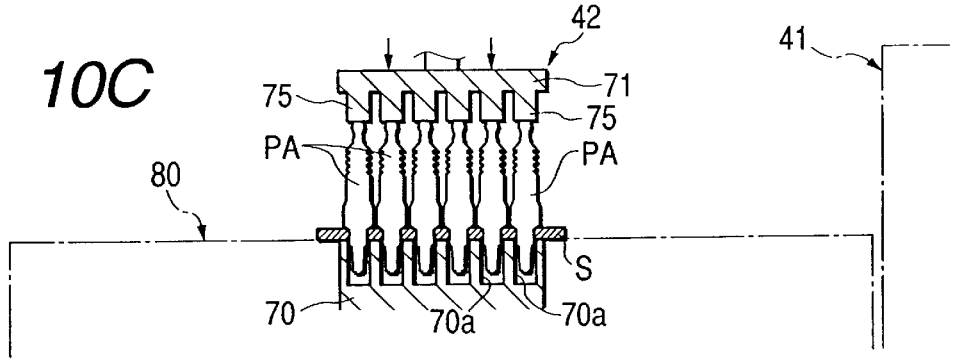
Figure 11A:
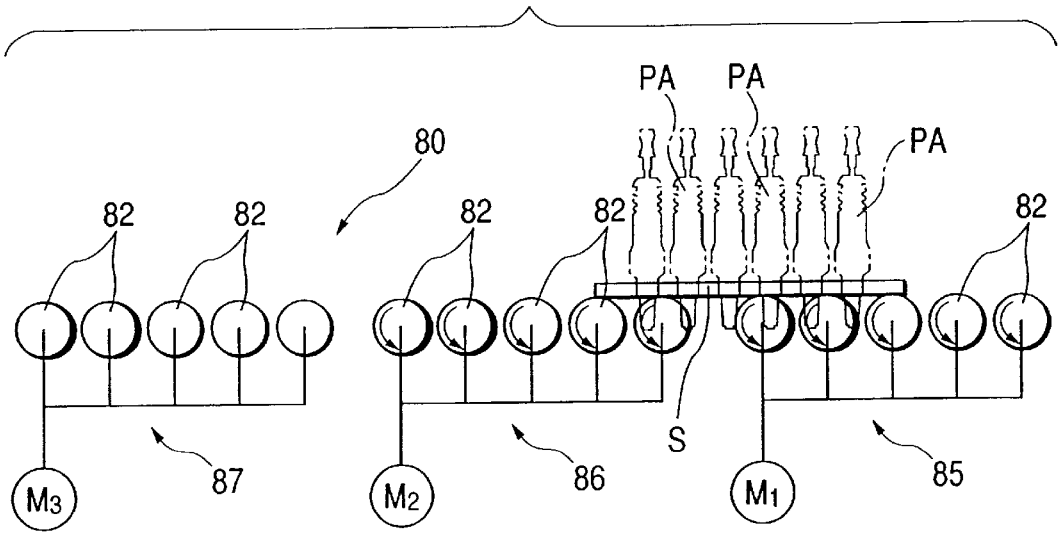
FIGS. 11A and 11B show schematically how the transport conveyor is operated.
Figure 11B:
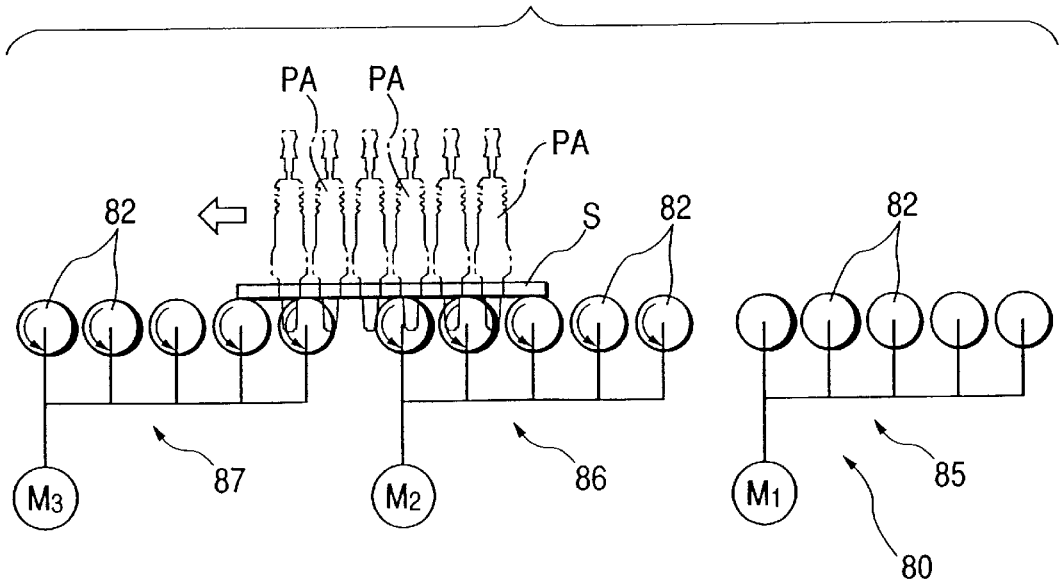

The setter S' (S) transferred onto the transport conveyor 80 as shown in FIG. 10A is driven by the entry conveyor 85 and the intermediate conveyor 86 to be transported to the pressing position in the press 42 (see FIGS. 11A to 11B). The driving by the conveyors 85 and 86 stops when the setter S has reached the pressing position as shown in FIG. 10A. Then, as shown in FIG. 10B, the lower die 70 of the press 42 ascends, whereupon the setter S is supported on the lower die 70 (also see FIG. 9). With the setter S supported in this way, the upper die 71 descends as shown in FIG. 10C, whereupon the metallic terminals 13 of spark plug assemblies PA are forced into the corresponding recesses 70*a* by means for the press pins 75 on the upper die 71 (see FIG. 12). As the result, the respective layers 25 to 27 in superposition are pressed axially (see FIGS. 3A and 3B) so that they are compressed and sintered to produce the conductive glass seal layer 16, the resistor 15 and the conductive glass seal layer 17 as shown in FIG. 3B.

Figure 10D:
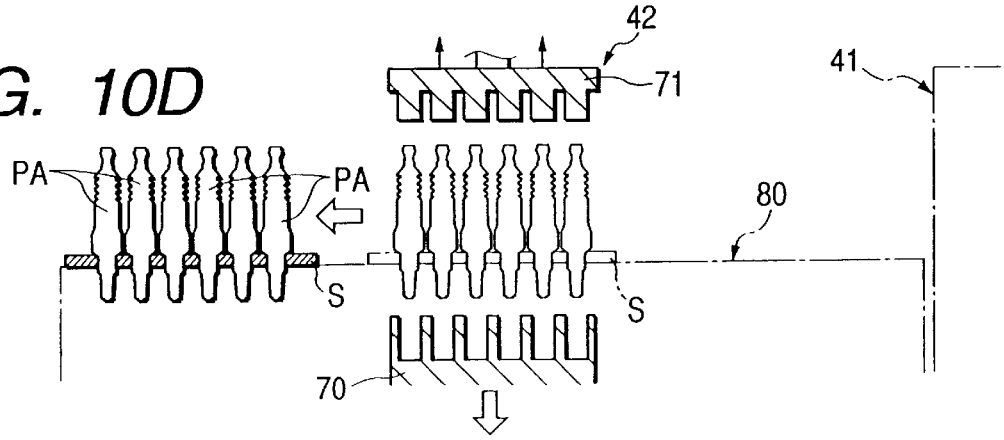

After the end of the pressing step, the lower die 70 descends and the upper die 71 ascends as shown in FIG. 10D and the press 42 returns to a stand-by position. Then, as shown in FIG. 11B, the intermediate conveyor 86 and the exit conveyor 87 are driven to rotate by motor M2 and M3 so that the setter S is ejected downstream from the pressing position. When the ejection of the setter S ends, the shutter 60 of the heating furnace 41 opens and the pusher 46 moves forward as shown in FIG. 5B. As the result, the setter S is pushed forward into the heating furnace 41 whereas the setter S' at the exit end is pushed out of the heating furnace 41.

The metallic shell 1, ground electrode 4 and any other necessary parts are mounted on the as-pressed spark plug assembly PA, whereupon the manufacture of the spark plug 30 shown in FIG. 1 is completed.

Figure 20A:
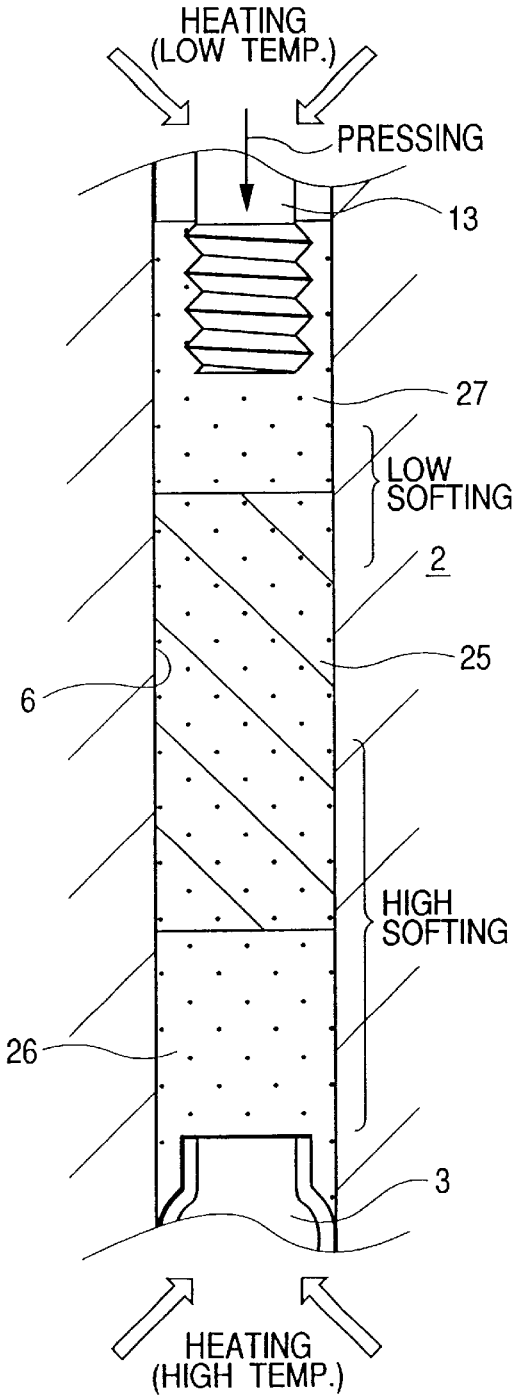
FIGS. 20A and 20B illustrate how a spark plug assembly is produced using the equipment shown in FIG. 4A.
Figure 20B:
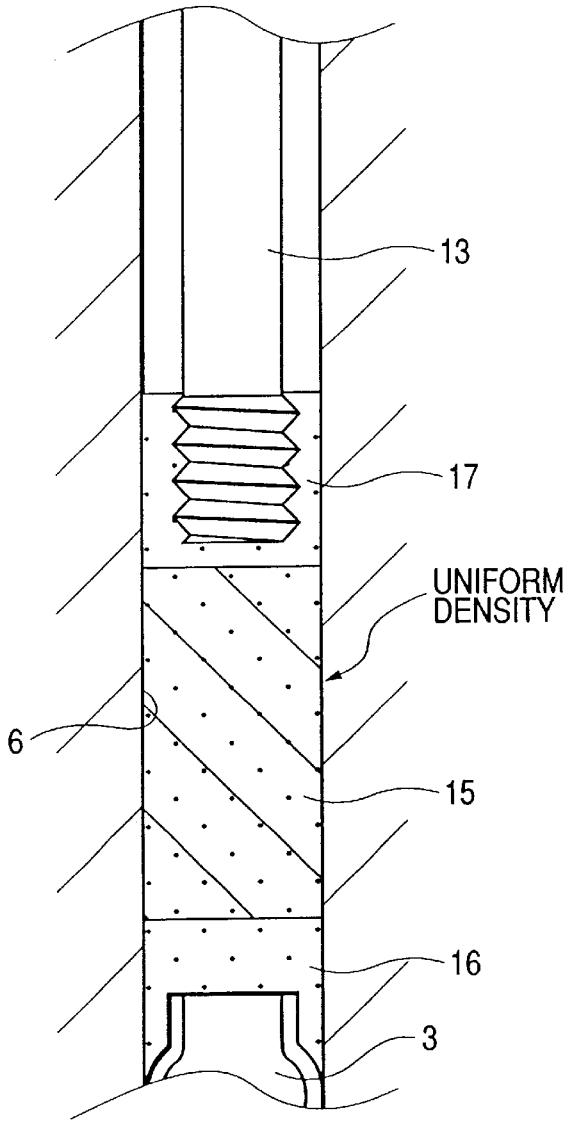

As will be apparent from the foregoing description of the spark plug production equipment 40 of the invention, the spark plug assemblies in the heating furnace 41 are heated in such a way that the side of each spark plug assembly which is closer to the center electrode 3 has a higher temperature than the side closer to the metallic terminal 13. Consequently, as shown in FIG. 20A, the softening of the glass in each of the superposed layers 25 to 27 will proceed more on the side closer to the center electrode 3 in the axial direction than on the side closer to the metallic terminal 13. Then, if axial pressure is applied to the metallic terminal 13, even the powder on the side closer to the center electrode 3 where only limited propagation of the applied pressure occurs undergoes reduced flow resistance as the softening of the glass proceeds and this allows the powder to be compressed as efficiently as the powder on the side closer to the metallic terminal 13. As the result, the glass seal layer 16 on the side closer to the center electrode 3 is compressed and sintered efficiently enough to ensure that satisfactory electrical connection is established at all times between the resistor 15 and the center electrode 3 with the glass seal layer 16 being interposed. As a further advantage, the resistor 15 that can be formed is uniformly sintered to have only a small density difference in the axial direction between the side closer to the metallic terminal 13 and the side closer to the center electrode 3 and this contributes to improve the performance of the resistor 15, particularly its life characteristics under load.

If desired, the conductive glass seal layer 16 which is located the closer to the center electrode 3 may use a glass having a lower softening point than the glass in the conductive glass seal layer 17 on the opposite side. In this alternative case, even if the spark plug assembly PA is heated in such a way that the side closer to the center electrode 3 has substantially the same temperature as the side closer to the metallic terminal 13, the glass in the seal layer closer to the center electrode 3 is the first to soften and the result will be the same as in the aforementioned case where the spark plug assembly is heated such that the side closer to the center electrode 3 has a higher temperature than the opposite side.

In the heating furnace 41, gas burners 48 and 49 are used as beating sources. In this design, unlike electric heaters and other devices than solely depend on the transfer of radiant heat, heating is achieved by the flame from the burners and, hence, the transfer of radiant heat is combined with heat transfer by convection due to the fluid motion of the flame. As the result, the efficiency of heat transfer to the spark plug assemblies PA is markedly improved and the desired temperature can be reached within such a short period that the heating time is sufficiently shortened to improve the production rate remarkably and realize great saving of energy. In addition, expensive electrical energy need not be used but the combustion energy of inexpensive gases is used to cut the energy cost.

In the heating furnace 41, the gas burners 48 and 49 are arranged in such a way that they are directed toward the top and bottom, respectively, of the line of spark plug assemblies PA that are erected on the setters S. This allows heat to be distributed evenly among the small gaps between adjacent spark plug assemblies PA by virtue of convected heat transfer. As the result, a large number of spark plug assemblies PA can be heated simultaneously and uniformly, thus achieving a marked improvement in both the efficiency and yield of spark plug manufacture.

Figure 14:
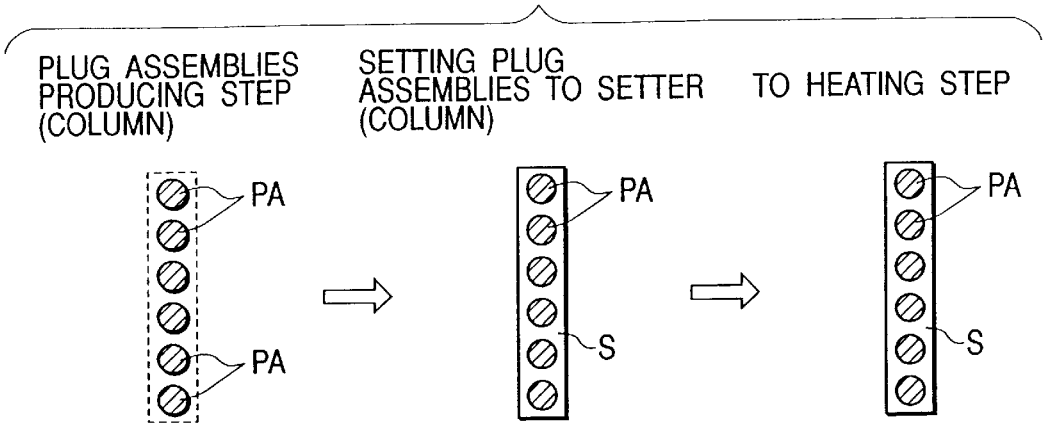
FIG. 14 illustrates a modification of FIGS. 13A to 13C.
Figure 15:
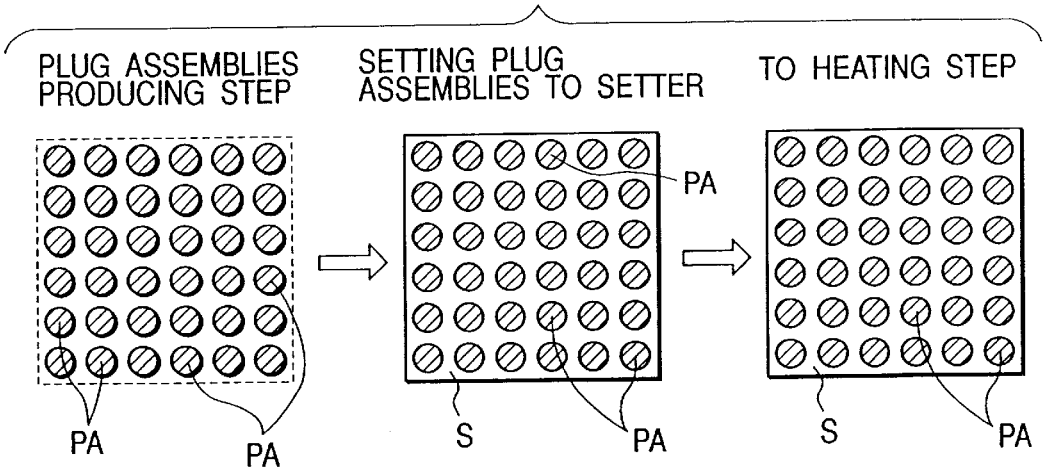
FIG. 15 illustrates another modification of FIGS. 13A to 13C.
Figure 16:
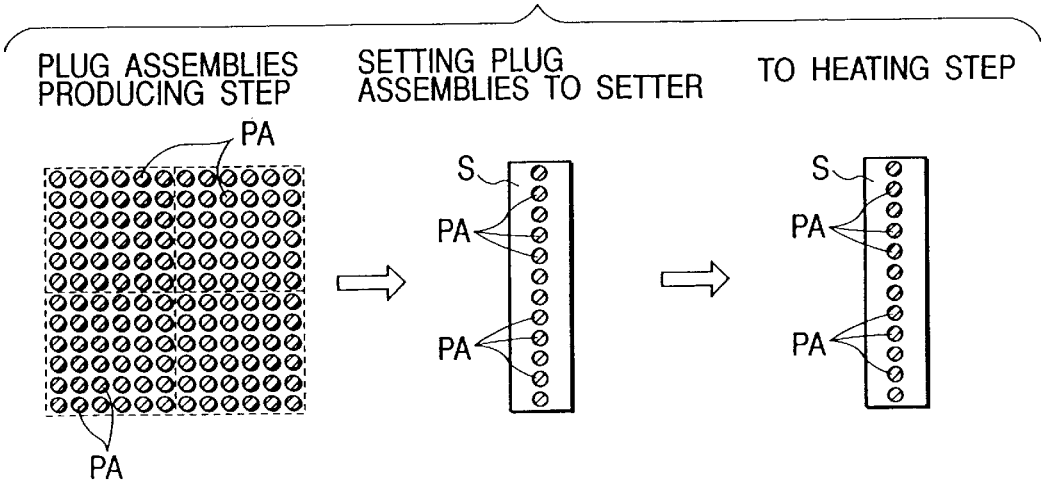
FIG. 16 illustrates yet another modification of FIGS. 13A to 13C.

The foregoing examples employ setters S each having a matrix array of spark plug assembly holding through-holes Sa. If desired, one may use setters S each having a single array of holding through-holes Sa as shown in FIG. 14. In this case, setters S are transferred into the heating furnace 41 each time a single array of spark plug assemblies PA are set in the holding through-holes Sa. Alternatively, insulators may preliminarily be arranged in a matrix in the spark plug assembly production step as shown in FIG. 15 and they are all subjected to simultaneous powder packing and preliminary compression so that spark plug assemblies PA are formed in the corresponding matrix. In this alternative case, the spark plug assemblies PA may be set on a setter S in the corresponding matrix or they may be set consecutively in the order of columns. Yet another method is shown in FIG. 16; a matrix array of spark plug assemblies PA are formed in the spark plug assembly production step and they are subsequently set in successive columns in a setter S having only a single array of spark plug assembly holding through-holes Sa.

Figure 17:
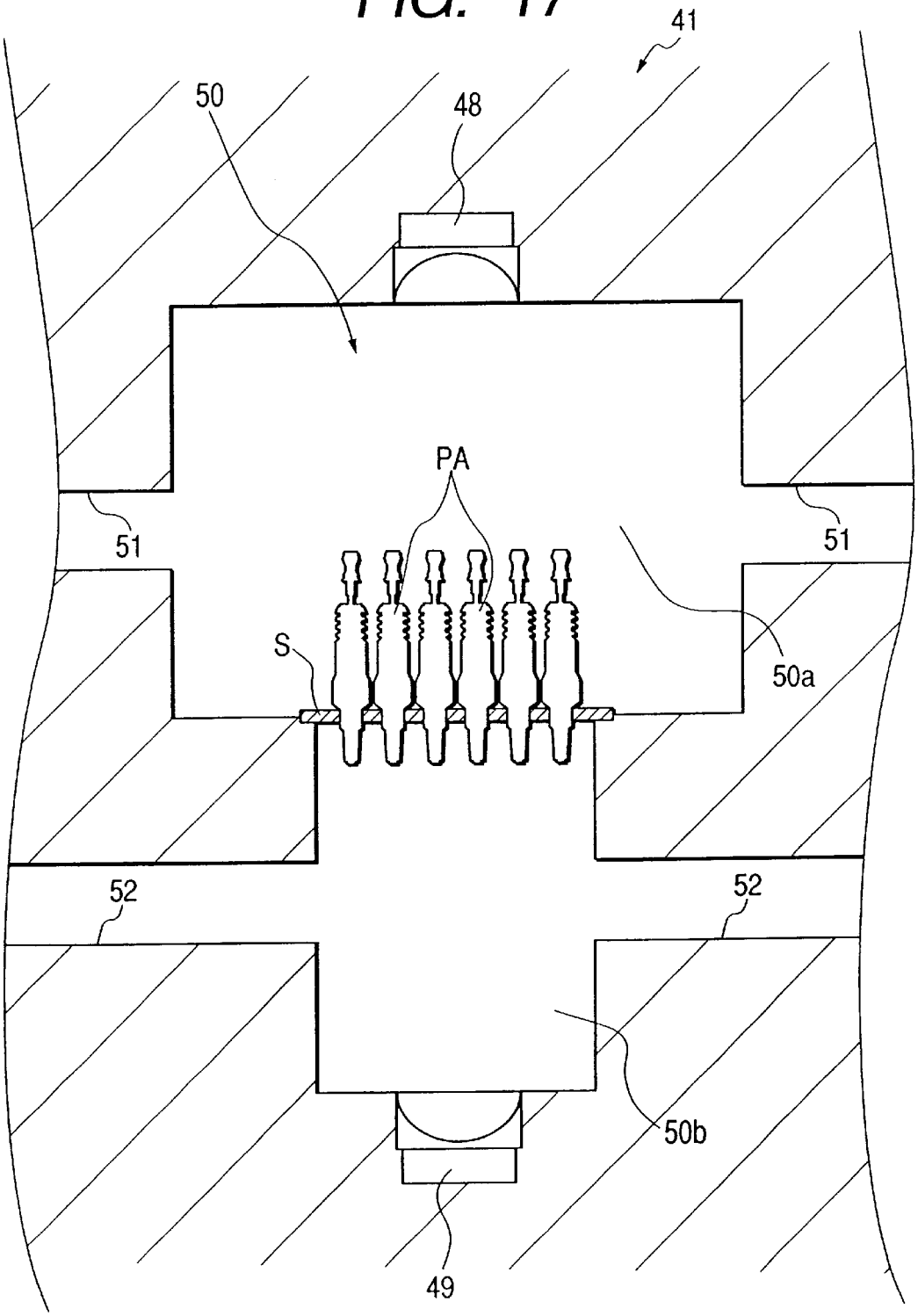
FIG. 17 shows a modification of the gas burners in the heating furnace.

The gas burners 48 and 49 to be used in the heating furnace 41 may be so modified that large burners of high energy intensity are arranged in a single row in the direction of PA transport as shown in FIG. 17. As already mentioned, the upper burners 48 may be omitted.

The means of transporting setters S through the heating furnace 41 is not limited to the pusher 46 and it may be replaced by drive rollers 90 as shown in FIGS. 18A to 18C. The drive rollers 90 may be made from ceramics such as alumina and they can be spaced along the guide grooves 45, with the roll surface 90*a* being partly exposed from the bottom 45*a* of each guide groove 45. With this arrangement, each setter S has the underside of its lateral sides supported by the roll surfaces 90*a* of drive rollers 90 and, at the same time, its movement in the direction of width is constrained by the lateral sides of the guide grooves 45. When the drive rollers 90 are driven to rotate by a suitable drive means such as a motor (not shown), the setter S will move along the guide grooves 45.

In any case, the upper heating chamber 50*a* and the lower heating chamber 50*b* are substantially separated. As shown in FIGS. 5A to 5C and FIG. 18A, the setters S are transferred while they are contact with each other.

In yet another embodiment, spark plug assemblies PA may be transported through the heating furnace with their orientation inverted from the one shown in FIG. 3A and the respective layers 25 to 27 shown in FIG. 3A are compressed in the press 42 with he metallic terminal 13 on the bottom being pushed up toward the center electrode 3 on the top. In this alternative case, the lower heaters 49 in the heating furnace 41 shown in FIG. 4A may be reduced in number or entirely omitted to ensure that the spark plug assemblies PA are heated such that the side closer to the center electrode 3 has a higher temperature than the opposite side.

Figure 19:
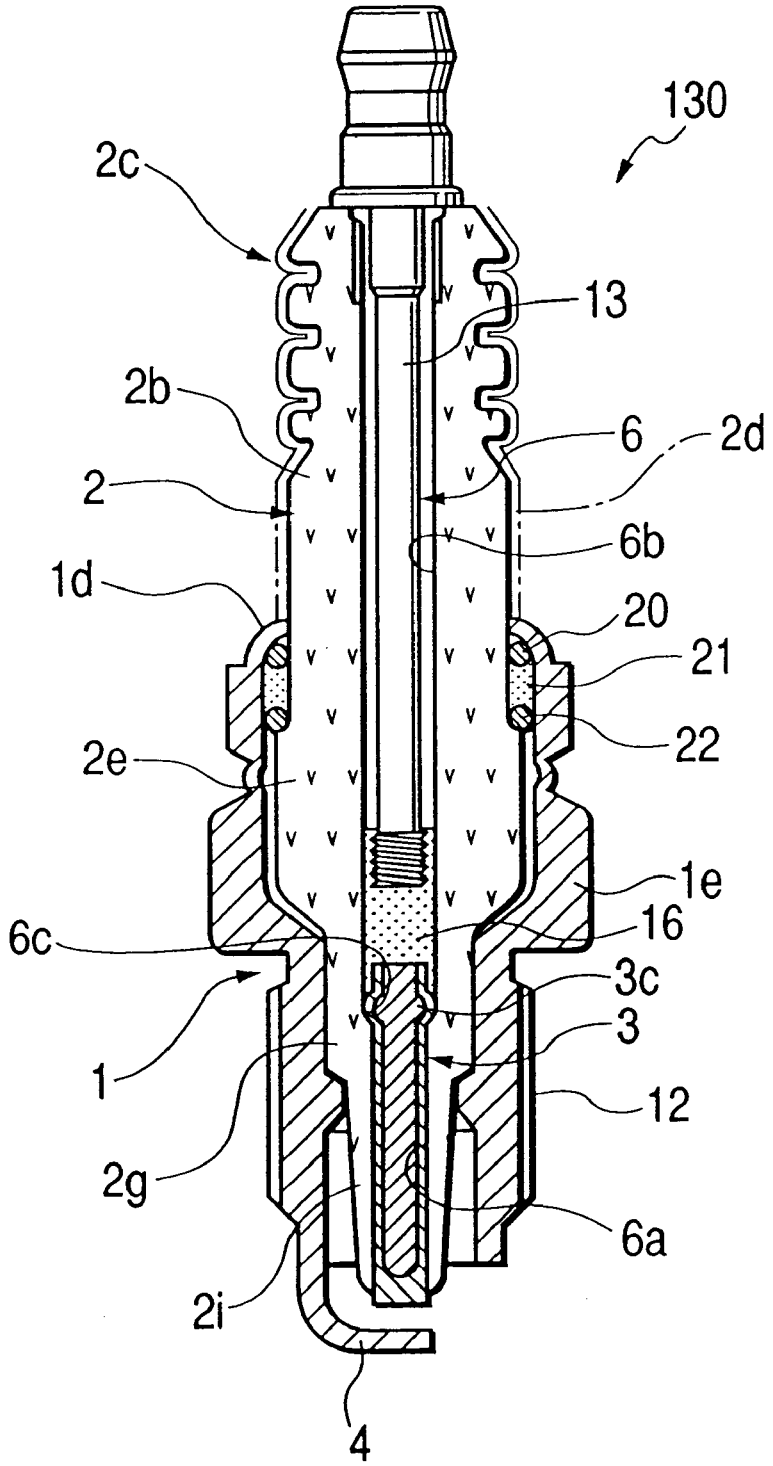
FIG. 19 is a front sectional view showing a modified spark plug.

It should finally be mentioned that the spark plug to be manufactured by the production equipment of the invention is in no way limited to the spark plug 30 with a built-in resistor that is shown in FIG. 1 and the concept of the invention is also applicable to a spark plug without resistor as indicated by 130 in FIG. 19. In the spark plug 130, the metallic terminal 13 and the center electrode 3 within the through-hole 6 in the insulator 2 are electrically connected to each other by means of a single glass seal layer 16 serving as a sintered conductive materiel member.

What is claimed is:

1. An equipment for producing a spark plug comprising an insulator in which a through-hole is formed in an axial direction of said insulator, a metallic element fixed at one end of said through-hole, a center electrode fixed at the other end of said through-hole and a sintered conductive material member comprising a mixture of glass and a conductive material being formed with the through-hole between the metallic terminal and the center electrode for connecting said metallic terminal and the center electrode electrically, said equipment comprising:

a heating device for non-uniformly heating a spark plug assembly comprising said insulator in which said through-hole is formed in an axial direction of said insulator, said metallic terminal fixed at one end of said through-hole, said center electrode fixed at the other end of said through-hole and packing layers of a bulk powder of the sintered conductive material member being formed in the through-hole between the metallic terminal and the center electrode so that said packing layers of the bulk powder begin to soften from the center electrode side along the longitudinal axis of the insulator.

2. The equipment according to claim 1, wherein said spark plug assembly is heated by said heating device so that the temperature of the center electrode side is higher than that of the metallic terminal side along the axial direction of said insulator.

3. The equipment according to claim 1, further comprising a press device for pressing the packing layers of the bulk powder within the through-hole by applying pressure to said spark plug assembly heated by said heating device so that said metallic terminal comes closer to said center electrode along the axis of the through-hole with the position of the center electrode being fixed relative to the through-hole.

4. The equipment according to claim 1, wherein said heating device is a heating furnace having a heating chamber formed in the interior thereof for accommodating the spark plug assembly, and said spark plug assembly is placed in said heating chamber so that said insulator erects in the axial direction; and further wherein said heating furnace is furnished with heating sources on a side that is either above or below said spark plug assembly placed in said heating chamber and which faces said center electrode.

5. The equipment according to claim 4, wherein said heating sources include gas burners.

6. The equipment according to claim 5, wherein said gas burners are each a cup burner comprising a cup-shaped heat radiator and a burner body, said heat radiator being oriented so that an opening from which heat is to be radiated faces said spark plug assembly and said burner body having a flame ejecting port that is open to the bottom of said cup-shaped heat radiator.

7. The equipment according to claim 4, wherein said heating furnace has an entrance portion through which said spark plug assembly to be heated is introduced into said heating chamber and an exit portion through which said heated spark plug assembly emerges from said heating chamber, a passage line for said spark plug assembly being formed along a path leading from said entrance portion to said exit portion via said heating chamber, a plurality of said heating sources being spaced along the passage line on whichever its top or bottom side that faces the center electrode; and further wherein said spark plug assembly is heated by a plurality of said heating sources while said spark plug assembly is transported continuously or intermittently along the passage line through said heating chamber.

8. The equipment according to claim 7, wherein the heating sources include gas burners and a plurality of the gas burners are spaced along the passage line on whichever its top or bottom side that faces the center electrode.

9. The equipment according to claim 8, further comprising a spark plug assembly holder for detachably holding said spark plug assembly so that said spark plug assembly is erected in the axial direction thereof, said spark plug assembly being transported through said heating chamber along the passage line while said spark plug assembly being held on said spark plug assembly holder;

wherein said spark plug assembly holder is adapted to hold a plurality of said spark plug assemblies at least across the width of the passage line so that said spark plug assemblies in said assembly holders are heated by said gas burners while being transported through the heating chamber.

10. The equipment according to claim 3, further comprising a spark plug assembly holder for detachably holding said spark plug assembly so that said spark plug assembly is erected in the axial direction thereof, said spark plug assembly being transported through said heating chamber along the passage line as said spark plug assembly being held on said spark plug assembly holder; and wherein the press device is provided adjacent to the exit portion of said heating furnace together with a transport mechanism by which said spark plug assembly emerging from said heating furnace is brought to a specified pressing position while being contained in the spark plug assembly holder.

11. The equipment according to claim 4, further comprising auxiliary heating sources in said heating furnace, said auxiliary heating sources being located on the side opposite to said heating sources in the axial direction of said insulator;

wherein said auxiliary heating sources generate less heat than said heating sources.

12. A method for producing a spark plug comprising an insulator in which a through-hole is formed in an axial direction of said insulator, a metallic terminal fixed at one end of said through-hole, a center electrode fixed at the other end of said through-hole and a sintered conductive material member comprising a mixture of glass and a conductive material being formed within the through-hole between the metallic terminal and the center electrode for connecting said metallic terminal and the center electrode electrically, said method comprising the steps of:

preparing a spark plug assembly having said metallic terminal fitted at an end of the through-hole in said insulator and said center electrode fitted at the other end thereof and packing layers of a bulk powder of said sintered conductive material member being formed in the through-hole between said metallic terminal and said center electrode;

heating said spark plug assembly so that said packing layers of the bulk powder begins to soften from the center electrode side along the axis direction of the insulator; and pressing said packing layers of the bulk powder within the through-hole between said center electrode and said metallic terminal by applying pressure to said heated spark plug assembly so that the metallic terminal comes closer to the center electrode along the axis of the through-hole with the position of said center electrode being fixed relative to the through-hole.

13. The method according to claim 12, wherein said spark plug assembly is heated so that the temperature of said center electrode side is higher than that of said metallic terminal side along the axis of said insulator.

* * * * *